US011320248B2

(12) United States Patent
Caldwell

(10) Patent No.: US 11,320,248 B2
(45) Date of Patent: May 3, 2022

(54) CHEMICAL AGENT DELIVERY RECEPTACLE WITH REUSABLE DIGITAL CONTROL CARTRIDGE

(71) Applicant: LIBERTY DYNAMIC, LLC, Sheridan, CO (US)

(72) Inventor: Marcus L. Caldwell, Colorado Springs, CO (US)

(73) Assignee: Liberty Dynamic, LLC, Sheridan, CO (US)

( * ) Notice: Subject to any disclaimer, the term of this patent is extended or adjusted under 35 U.S.C. 154(b) by 0 days.

(21) Appl. No.: 17/110,855

(22) Filed: Dec. 3, 2020

(65) Prior Publication Data

US 2021/0180928 A1 Jun. 17, 2021

Related U.S. Application Data

(60) Division of application No. 16/441,874, filed on Jun. 14, 2019, which is a continuation of application No. PCT/US2019/037233, filed on Jun. 14, 2019.
(Continued)

(51) Int. Cl.
*F42B 12/42* (2006.01)
*F42B 12/46* (2006.01)
(Continued)

(52) U.S. Cl.
CPC ..... *F42B 12/42* (2013.01); *F42B 12/46* (2013.01); *F42C 11/003* (2013.01);
(Continued)

(58) Field of Classification Search
CPC ..... F42B 12/42; F42B 12/46; F42C 11/003; F42C 11/065; F42C 19/0803; F42C 19/0823
(Continued)

(56) References Cited

U.S. PATENT DOCUMENTS 6,253,680 B1 7/2001 Grubelich
6,640,721 B1 * 11/2003 Standback ..... F42C 14/08 102/498
(Continued)

FOREIGN PATENT DOCUMENTS

AU 2015359425 A1 * 7/2017 ..... F42C 15/34
CN 110631434 A * 12/2019
(Continued)

*Primary Examiner* — Samir Abdosh
(74) *Attorney, Agent, or Firm* — James W. Huffman; Huffman Law Group, PC

(57) ABSTRACT

A digitally controlled hand-tossable explosive delivery receptacle comprises a ruggedized reusable compartment enclosing a digital circuit and a disposable cartridge holding one or more explosive chemical agents and a primer. The disposable cartridge is configured to be mounted to the ruggedized reusable cartridge, and a high-strength bulkhead incorporated into the reusable or disposable compartment that separates the digital circuit from the chemical agents. The reusable compartment is sufficiently ruggedized to withstand the ignition of the primer and the detonation of the chemical agents to be reused with one or more additional disposable cartridges. In one implementation, the delivery receptacle uses a commercial airbag initiator as the primer, which is arranged in relation to the one or more chemical agents so that when the initiator is activated, it generates a pressure wave that expels the one or more chemical agents from the grenade.

20 Claims, 9 Drawing Sheets

Related U.S. Application Data

(60) Provisional application No. 62/684,861, filed on Jun. 14, 2018.

(51) Int. Cl.
*F42C 11/00* (2006.01)
*F42C 11/06* (2006.01)
*F42C 19/08* (2006.01)

(52) U.S. Cl.
CPC ..... *F42C 11/065* (2013.01); *F42C 19/0803* (2013.01); *F42C 19/0823* (2013.01)

(58) Field of Classification Search
USPC ..... 102/487
See application file for complete search history.

(56) References Cited

U.S. PATENT DOCUMENTS 7,412,929 B2 8/2008 Walsh
7,845,280 B2 12/2010 Caldwell
8,051,776 B1 * 11/2011 Bailey ..... F42B 5/24 102/529
9,587,920 B1 * 3/2017 Yoon ..... F42B 27/00
2006/0096490 A1 * 5/2006 Hsieh ..... F42B 8/26 102/498
2006/0230972 A1 * 10/2006 Ouliarin ..... F42B 12/42 102/487
2011/0219977 A1 * 9/2011 Lucas ..... F42D 1/043 102/202.7
2012/0097062 A1 * 4/2012 Scanlon ..... F42B 8/14 102/513
2017/0049917 A1 * 2/2017 Kellett ..... F42B 12/50
2020/0333119 A1 * 10/2020 Caldwell ..... F42C 19/0823

FOREIGN PATENT DOCUMENTS

EP 2083239 B1 * 4/2015 ..... F42B 27/00
KR 101867307 B1 * 6/2018
RU 2471142 C1 * 12/2012

* cited by examiner

Legend:

| | |
|---|---|
| R1, R4: | 100KΩ |
| R2, R7: | 10K |
| R3, R6: | 4.99K |
| R5: | 2.49K |
| R8: | 3.32K |
| R9-R12: | 68 |
| R13: | 0.1 |
| R14-R15: | 68 |
| R16-R21: | 10K |
| R22-R23: | 20K |
| R24: | 976K |
| R25: | 562K |
| R26: | 20K |
| C1: | 0.1μF |
| C2-C6: | 10μF |
| L1: | 4.7μH |
| F1: | 1A |
| Q1-Q2: | 10μF |
| Q3: | DMN1019 |
| CR1: | LSM115J |
| U1: | 16F15345 |
| U2: | MCP1623 |

CHEMICAL AGENT DELIVERY RECEPTACLE WITH REUSABLE DIGITAL CONTROL CARTRIDGE

RELATED APPLICATIONS

This application claims the benefit of U.S. Provisional Patent App. No. 62/684,861, filed Jun. 14, 2018, and entitled "Enhanced Diversion Device Assembly," which is herein incorporated by reference for all purposes. This application is also a continuation of PCT/US19/37233 filed Jun. 14, 2018, which claims the benefit of 62/684,861 and is also herein incorporated by reference.

TECHNICAL FIELD

This application relates to the field of controlled detonation and more particularly to flash bang diversionary devices.

BACKGROUND

Stun grenades (aka flashbang devices) are used to temporarily incapacitate and disorient subjects, giving law enforcement or military personnel time to safely exert control over the subjects. Prior art stun grenades are typically engineered to produce a flash at least 1 million candela (the brightness of the sun) and as bright as 7 million candela or more. They are also typically designed to produce a bang as great as 170 dB or more. The flash typically blinds a subject in close proximity (e.g., in the same room as the stun grenade) 5 seconds or more and, after that, leaves an afterimage that impairs their aim. The bang temporarily deafens the subject and disturbs the fluids in the inner ear canal, disrupting balance. The overpressure from the blast is also disorienting.

Stun grenades are frequently used in police raids and in house-to-house military sweeps to provide a tactical advantage. Many grenades used by the U.S. military feature a steel can, a spoon, and a M209 percussion-style chemical stack fuse. After the pin is pulled and the spoon flies, a spring-loaded arm (frequently referred to as a "hammer" or "striker") flips over, striking a primer that starts a chain reaction of controlled combustion of a chemical delay fuse. The chemical delay fuse typically burns for roughly 1.5 seconds, with an accuracy of only about ±0.5 seconds, before igniting the flash powder inside the can. The explosion occurs inside the can and is momentarily contained in the can to create an overpressure that blasts out both ends of the can, creating a fireball and a thump.

There are some drawbacks to conventional stun grenades. The chemical delay fuse is not always accurate—the fuse can burn in as little as 0.5 seconds and as much as 2 or more seconds before igniting the flash powder. Also, the explosion is vented horizontally through vents that are typically at the two ends of the grenade, which lay down close to the floor. This drives much of the energy into the ground (or a piece of furniture or a blanket on which the grenade lands), and very little of the energy to face level where it would create a greater effect. The percussive force of the blast is also less for persons standing or sitting perpendicular to the can. Because of their cylindrical, round, or many-sided polygonal shape (e.g., the hexagonal caps of the M84 stun grenade), grenades may role around on the floor, making them hard to locate. This is a particular concern if the grenade fails to go off.

Conventional stun grenades contain much of the explosion within the case, becoming extremely hot (e.g., 1500° C.). Both the venting of the explosion and the grenade itself are hot enough to catch curtains, carpets, blankets, and furniture in which the explosion or grenade comes into contact with on fire. Consequently, the use of conventional stun grenades often results in ignition of fire to the building. This, in turn, results in potential liability for law enforcement agencies.

A stun grenade can also create its own fragmentation by mobilizing anything next to its vents into shrapnel, potentially injuring or killing a person. Stun grenades, which are frequently held in an officer's vest, also utilize volatile flash powder, which is susceptible to being triggered by a high-speed secondary impact, such as a gunshot.

For these reasons, many agencies have limited the use of stun grenades for purposes of crowd control.

SUMMARY

Several embodiments of a chemical delivery receptacle are provided that improve on one or more aspects of a conventional grenade or stun device. In one embodiment, a digitally controlled hand-tossable explosive delivery receptacle comprises a ruggedized reusable compartment enclosing a digital circuit and a disposable cartridge holding one or more explosive chemical agents and a primer. The disposable cartridge is configured to be mounted to the ruggedized reusable cartridge, and a high-strength bulkhead incorporated into the reusable or disposable compartment that separates the digital circuit from the explosive chemicals. The reusable compartment is sufficiently ruggedized to withstand the ignition of the primer and the detonation of the explosive chemicals to be reused with one or more additional disposable cartridges.

In a preferred implementation, the primer is selected to generate heat sufficient to detonate the explosive chemicals. The disposable cartridge has one or more reservoirs that store the one or more explosive chemicals prior to detonation and a primer port that provides a fluid passageway between the primer and the reservoirs. The digital circuit is configured to be manually activated by a person handling the receptacle and, when activated, to check for a set of conditions and ignite the primer when the conditions are met, consequently detonating the explosive chemicals.

In another embodiment, a remotely activated grenade comprises one or more explosive chemicals, a primer selected to generate heat sufficient to detonate the explosive chemicals, a reusable compartment enclosing a digital cartridge, and a disposable cartridge that mounts to the reusable compartment. The disposable cartridge has one or more reservoirs that store the one or more explosive chemicals prior to detonation and a primer port that provides a fluid passageway between the primer and the reservoirs. The digital circuit includes a wireless communications module that is configured to receive wireless instructions and, in response to an ignition instruction, check for a set of conditions and ignite the primer when the conditions are met, consequently detonating the explosive chemicals.

In another embodiment, a hand-tossable grenade comprises one or more chemical agents and an airbag initiator arranged in relation to the one or more chemical agents so that when the initiator is activated, it generates a pressure wave that expels the one or more chemical agents from the grenade.

In implementations that also include other aspects of the inventions of this disclosure, the first compartment includes a shock-resistant bulkhead for shielding the first circuit in the first compartment from a pressure wave generated in the second compartment, the first circuit includes a power supply, and the second circuit comprises an electrically activated initiator configured to generate a pressure wave to expel, mix, and/or detonate chemical agents contained in the second compartment.

Other systems, devices, methods, features, and advantages of the disclosed product and methods will be apparent or will become apparent to one with skill in the art upon examination of the following figures and detailed description. All such additional systems, devices, methods, features, and advantages are intended to be included within the description and to be protected by the accompanying claims.

BRIEF DESCRIPTION OF THE DRAWINGS

The present disclosure may be better understood with reference to the following figures. Corresponding reference numerals designate corresponding parts throughout the figures, and components in the figures are not necessarily to scale.

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

DETAILED DESCRIPTION

Figure 1:
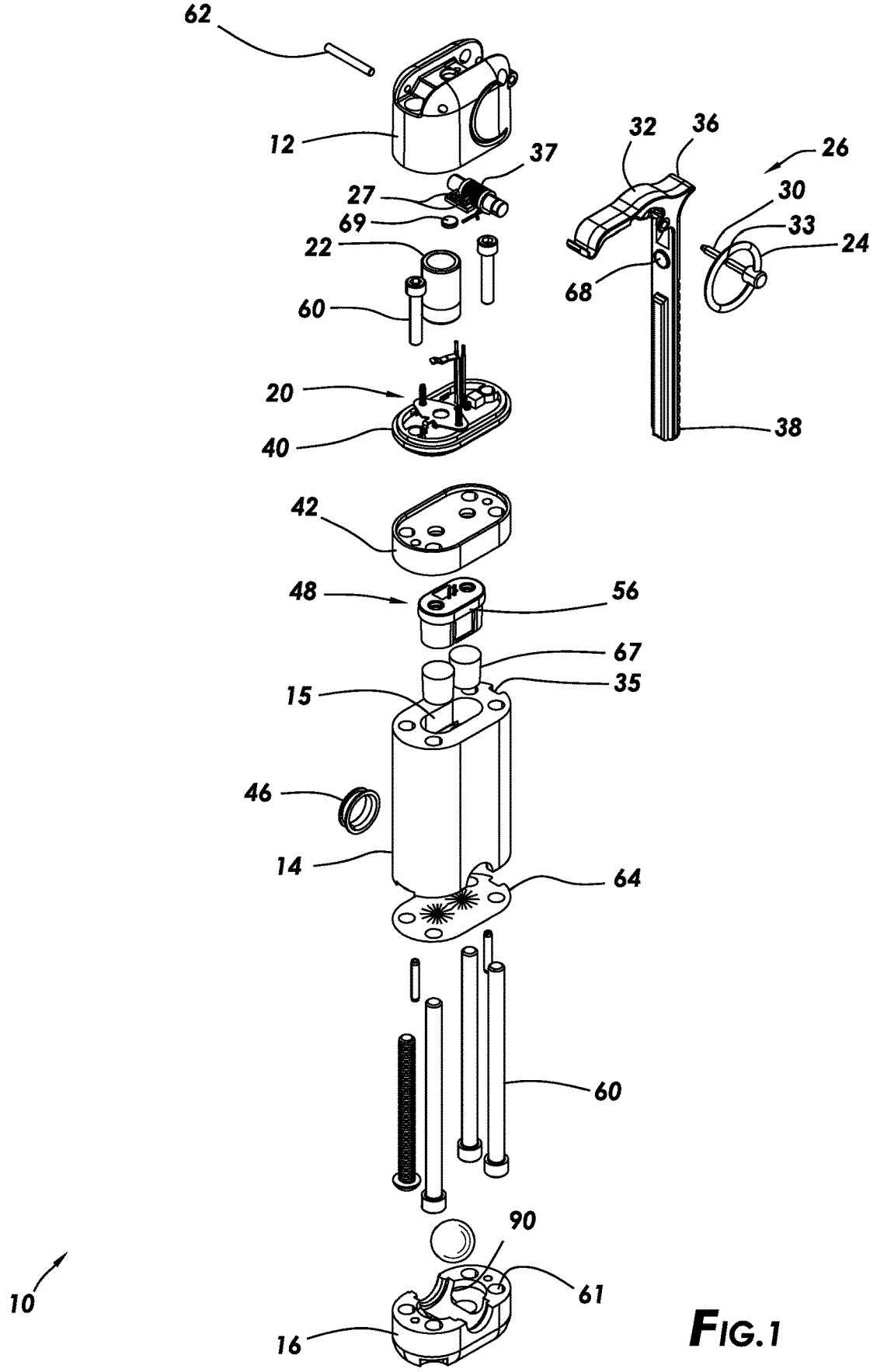
FIG. 1 is an exploded view of one embodiment of a chemical and/or explosive agent delivery device.

Any reference to "invention" within this document is a reference to an embodiment of a family of inventions, with no single embodiment including features that are necessarily included in all embodiments, unless otherwise stated. Furthermore, although there may be references to "advantages" provided by some embodiments, other embodiments may not include those same advantages, or may include different advantages. Any advantages described herein are not to be construed as limiting to any of the claims.

Specific quantities (e.g., spatial dimensions) may be used explicitly or implicitly herein as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in the invention.

In describing preferred and alternate embodiments of the technology described herein, various terms are employed for the sake of clarity. Technology described herein, however, is not intended to be limited to the specific terminology so selected, and it is to be understood that each specific element includes all technical equivalents that operate similarly to accomplish similar functions. Where several synonyms are presented, any one of them should be interpreted broadly and inclusively of the other synonyms, unless the context indicates that one term is a particular form of a more general term.

For example, in the specification that follows, an initiator 54 is described as being variously known as a detonator, squib, or electrically initiated primer. When any of these terms are used in the claims, the term is properly construed to cover anything that the declared synonyms would cover. Another example is the use of the terms "electrodes" and "terminals." While some definitional sources strain to provide distinct meanings of the terms, as a practical matter they are widely used interchangeably. Thus when used in a claim, either "electrode" or "terminal" should be understood to encompass both what is more technically considered to be an "electrode" and what is more technically considered a "terminal." As yet another example, the present specification uses the term "piston" to refer to what is basically a plug that travels the length of a cylindrical reservoir 44. Many sources define a "piston" as a disk connected to a rod that travels up and down a cylinder, but this term is not intended to be construed so narrowly, as the specification describes the piston without a connected link or rod and as an object that travels one way down the reservoir 44, disintegrating along the way.

The present invention relates to an explosive delivery receptacle or device 10. Its most prominent expected application is as a nonlethal hand-launched noise-and-flash diversion device (also referred to as a "flash bang" or "stun grenade" device) used as a stun grenade. However, it also has application to lethal grenades. In most applications, it is expected that the device 10 is ergonomically designed to be hand-thrown or lobbed. But deployment using grenade launchers and land, air, and water-based delivery vehicles is also contemplated. The terms "explosive delivery receptacle" and "explosive delivery device" (along with its reference number 10) extends to all of these applications.

Some of the more notable distinguishing aspects of the explosive delivery receptacle or device 10 are the structure of the device 10, the reusability of part of that structure, the device's provision of two or more reservoirs for holding a reactant and a reagent (such as a fuel and an oxidizer), components that ensure a reliable circuit connection, and safety features incorporated into the device 10. Because all or many of these features are believed to be separately patentable, several independent patent applications are being simultaneously filed for the features and various combinations of the features. It will be appreciated that the invention is not limited to a mandatory inclusion of any of these features, but rather is limited by the explicitly described limitations of the claims.

I. MECHANICAL STRUCTURE OF THE ELECTRICAL DELIVERY RECEPTACLE

A. Division into Reusable and Disposable Compartments

Referring to the Figures, an embodiment of a chemical agent delivery receptacle 10 is shown. The chemical agent receptacle or device 10 comprises a case or body 11 that has at least two separable compartments—a reusable digital control compartment 12 (referred to in the provisional specification as a fuse assembly), a disposable compartment 14, and optionally also an end cap 16. The primary benefit of including an end cap 16 is that it is less costly to machine the mixing chamber 45 by splitting a blank along the equator of the exhaust or discharge port 43 (described below). The optional end cap 16, when detached from the disposable compartment 14, also provides access to the reservoirs 44, which may be useful in forensics. Also, in situations where the disposable compartment 14 is recyclable despite the forces of an initiator discharge, then the optional end cap 16 might be needed in order to clean the reservoirs and mixing chamber (also described below). But apart from these advantages, a unitary reload compartment that incorporates both the depicted disposable compartment 14 and the end cap 16 will likely be just as tactically useful as the depicted embodiment. Accordingly, it should be understood that when the claims recite a disposable compartment or cartridge without disclosing an end cap, the element should be construed to cover both the depicted embodiment and a unitary reload compartment.

In various embodiments, one or both or all three of the compartments 12, 14 and 16 are formed from extruded aluminum with secondary machining. Advantageously, the use of extruded aluminum increases the resilience of the case compartments, minimizing the potential of fragmentation and stress fracturing.

B. Reusable Digital Control Compartment

The digital control compartment 12 and components thereof mediate between a manual action to detonate the device 10 and a digital action to activate an initiator 54 to detonate the device 10. Disposed within the reusable digital control compartment 12 is a digital detonation control circuit 18 (referred to in the provisional specification as a "digital fuse" and alternatively referred to herein as a "digital delay circuit") and power supply switch 19. The digital detonation control circuit 18—which is described in more detail in conjunction with FIG. 11—comprises a battery 22, an electronic circuit board 20, a microprocessor 21 mounted on the board and programmed with firmware, a battery 22 to supply power to the digital control circuit 18, an assortment of transistors Q1-Q3, resistors R1-R23, capacitors C1-C6, and other common electrical components mounted on the board 20, and multiple safety switches, including a reed switch 23, a pair of mechanically switched power switch terminals 27, a fuse or fusible link 31 (or, less preferably, a circuit breaker), and a pair of activation terminals 29. In an alternative embodiment, many of these components are replaced by an FPGA.

The digital control compartment 12 is sufficiently ruggedized to make it reusable with multiple disposable compartments 14. One particularly rugged portion of the digital control compartment 12 is a high-strength bulkhead 42 located at an end of the digital control compartment 12 that connects to the disposable compartment 14. The high-strength bulkhead 42 is structurally and functionally comparable to the breech of a cannon, and comprises hardened (i.e., heat-treated) steel having a tensile strength preferably in excess of 30,000 psi shields the contents of the digital control compartment 12 from the pressure wave generated by a detonator 54, described below. In addition or in the alternative, a high-strength bulkhead 42 is incorporated into the disposable compartment 14.

C. LED Light Ring

The digital detonation control circuit 18 also controls an array of multi-colored LED indicator lights 40 (D1-D8). The LED indicator lights 40 indicate the operational status and impending detonation of the delivery receptacle 10. In a preferred embodiment, the LEDs are arranged in an optically clear light ring around the case 11, more particularly, about a lower edge of the reusable compartment 12. The LED indicator lights 40 provides status info about the device 10 to the operator, including battery life, the number of uses remaining, failure conditions, and impending detonation.

D. Disposable Compartment

The disposable compartment 14 (also referred to as a "reload cartridge") contains one, two, or more reservoirs or chambers 44. One implementation with a single-reservoir 44 holds an explosive charge such as flash powder. Another implementation with two reservoirs 44 holds ingredients of a binary explosive (e.g., a fuel and an oxidizer or a reagent and reactant) that are relatively stable and harmless until mixed. For example, in one embodiment, a finely ground aluminum powder is provided in one reservoir 44 and potassium perchlorate ($KClO_4$), an oxidizer, provided in the other reservoir 44, all in accordance with their stoichiometric ratios.

Other implementations use one of the one or more reservoirs 44 to hold non-explosive chemical agents, such as a lachrymator (e.g., tear gas), capsaicinoid (e.g., pepper spray), ammonia, or a noxious or malodourous chemical to sting the eyes and/or make breathing difficult or unpleasant. Another implementation provides BB's or shrapnel in one of the reservoirs 44.

The reload cartridge 14 is disposable, single use, and hermetically sealed. In a preferred embodiment, the reload cartridge 14 is pre-loaded at the factory with the correct binary explosive ingredients in stoichiometric ratios. In a less preferred embodiment, the disposable cartridges 14 are obtained in an empty condition and filled by military personnel or officers on the field.

E. Initiator, Housing, and Seat

The disposable compartment 14 also provides a seat, socket, port or dock 15 (which alternative terms are used interchangeably in this application), for receiving and holding a miniature explosive device 54, also known as an initiator, detonator, primer, or squib (which terms are also used interchangeably in this application), to atomize, eject and detonate and/or disperse the chemicals. In general, an initiator is a substance that starts a chemical reaction and, in the context of explosives, an explosive or device used to detonate a larger one.

In one embodiment, the reservoirs 44 are open-ended. On a top end, the one or more reservoirs 44 are in fluid communication with the initiator dock 15. On a bottom end, each reservoir 44 has an outlet or exhaust port 43 through which the explosive agents are discharged or, more specifically, expelled with high force. The port 15 provides a fluid connection between the initiator 54 and the reservoirs 44 so that the pressure wave created by the initiator 54 expels the explosive agents from the reservoirs 44.

In an alternative implementation, the reusable digital control compartment 12 provides a squib seat or dock 15 for the initiator 54 on the outside of the bulkhead 42. In another alternative embodiment, both the reusable compartment 12 and the disposable compartment 14 provide structure for holding the initiator 54 between the two compartments 12 and 14. In each of these implementations, one or more frangible, hermetic seals 64 are preferably provided to hold the explosive agents within the reservoirs 44 prior to initiator 54 detonation.

In one embodiment, the initiator 54 is a charge-activated initiator such as a commercial DOT-compliant (i.e., compliant with U.S. Department of Transportation regulations) airbag initiator comprising a thin electrical bridgewire 70 wrapped or encased in a solid propellant 72 such as sodium azide. A bridgewire is defined as a relatively thin resistance wire used to set off a pyrotechnic composition serving as a pyrotechnic initiator. When the bridgewire 70 is energized by a high current pulse (e.g., 1A-3A), it heats up and ignites the solid propellant 72, which undergoes a rapid chemical reaction known as a pyrotechnic chain and generates a blast of inert gas. The gas rapidly forces the chemicals stored in the reservoirs 44 into the mixing chamber 45 and out the topmost-facing outlet port 43. Advantageously, airbag initiators are very robust and not easily set off with static electricity. They also have very predictable behavior, and—when used in conjunction with the other novel innovations described in this specification—dependably avoid pre-detonating the chemical agents inside the device 10.

Partially disposed within the reload housing 14 is an initiator assembly 48. The initiator assembly 48 includes an initiator housing 50 with an interface PCB 52 and an initiator 54 disposed within the interface housing 50. One or two electrodes (i.e., bridgewire ends) on the interface PCB 52 terminate in malleable solder pads 71 made of a soft, malleable lead-free solder with a hardness (per the Moh Hardness scale) less than that of lead. In one implementation, for example, Indium or Indium alloy solder provides contact areas for one or two ruggedized activation terminals 29 of the detonation control circuit 18. The malleability of the solder facilitates an interference fitting (similar to the wiping action that occurs when plugging an electrical plug into a wall socket) between the ruggedized activation terminals 29 and the solder pads 71. A spring 73 enclosed within the initiator assembly 48 also facilitates the interference fit. When the terminals 29 press into the solder pads 71, the interface PCB 52 is depressed about 1/10 of an inch against the spring 73.

Figure 2:
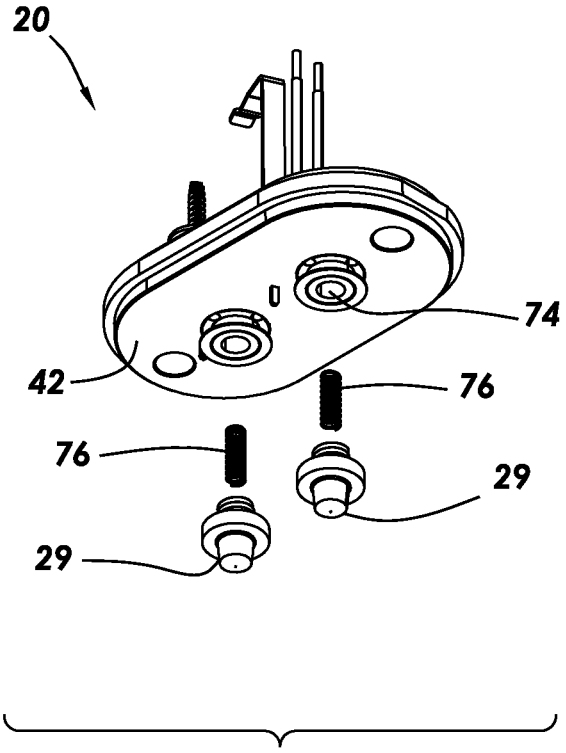
FIG. 2 is an exploded view of a first portion of a ruggedized electrical connector of the delivery device.

In FIG. 2, the ruggedized activation terminals 29 resemble hippo teeth. Each terminal 29 comprises a shaft with tapered, frustoconical sides and a blunt end or tip (i.e., an end or tip that is anything ranging between flat, round, and modestly pointed—but not pointed enough to form an acute angle). The tapered sides of the shaft are configured to deflect an air pressure wave directed at the first electrical terminal toward a base of the first component sideways. The robust frustoconical profile of the shaft resists bending and deformation under the shock forces, enabling them to be reconnected to new disposable cartridges 14 after multiple detonations.

This interference fit maintains an electrical connection between the activation terminals 29 and the solder pads 71 as the device 10 is handled, thrown, and impacted when the device 10 hits the ground or an object. The malleability of the solder 71 also makes the solder resistant to breakage under shock. Testing proves that the electrical connection is durable and reliable under realistic use conditions.

The initiator housing 50 has a ridge or projection 56 around an outer surface of the initiator housing 50 and prevents the housing 50 from being completely inserted into the reload cartridge 14. The initiator housing 50 is covered at a top edge by an initiator connection plate 58.

The ruggedized activation terminals 29 of the detonation control circuit 18 protrude through small openings 74 in the bulkhead 42 to activate the initiator 54. When the reusable compartment 12 is assembled to the reload cartridge 14, the activation terminals 29 are arranged to press into the soft-metal solder pads 71 of the initiator 54.

The ruggedized activation terminals 29 are isolated from the detonation control circuit 18 by gold-plated compression springs 76 fitted over the terminals 29 that mechanically isolate the detonation control circuit 18 from shock forces acting on the bulkhead 42. This keeps the detonation control circuit 18 in electrical contact with the initiator 54 even as the device 10 is tossed and as it collides with the floor or other object.

F. End Cap, Exhaust Ports and Ball

For embodiments that include it, the end cap 16 defines a bottom portion of a mixing chamber 45 in which the explosive agents are atomized and/or mixed prior to being ignited by the heat from the initiator 54 detonation. Likewise, a shaped bottom of the disposable compartment 14 defines a top portion of the mixing chamber 45. In embodiments that utilize a unitary reload compartment in place of the disposable compartment 14 and end cap 16, the unitary reload compartment defines the mixing chamber 45 in its entirety. With respect to either type of embodiment, at least one and preferably two outlet/exhaust ports 43 may be defined in the in the mixing compartment 45. In the depicted embodiments, a portion of a lower edge of the disposable compartment 14 and an upper edge of the end cap 16 are cut out to form the exhaust port(s) 43. Once the frangible, hermetic seal(s) 64 is/are broken, the reservoirs 44 are in fluid communication with the exhaust port(s) 43.

In the illustrated embodiments, the two oppositely positioned exhaust ports 43, along with a ball 65 in the chamber 45 sized and shaped to plug and seal the bottom-most facing exhaust port 43, provide a unique and significant advantage.

Because the case 11 has two flat major sides, the case 11, when thrown, tends to land on one of its flat major sides. The minor sides are preferably rounded, helping to cause the case 11, if it lands on its minor side, to come to rest on one of its two major sides. Because the case 11 is not cylindrical or substantially round (e.g., a pomegranate-style grenade) in shape, the case 11 is less likely to roll under a piece of furniture, flammable drapes, or the like. Furthermore, when the case 11 comes to rest on a flat or substantially flat surface, the ball 65 rolls into the bottom-most facing exhaust port 43, blocking it.

When the chemicals are violently pushed into the mixing chamber 45, the pressure of the initiator blast wedges the ball 65 into the bottom-most facing exhaust port 43, plugging and sealing it. Rounded or sloped inclusions 90 in the mixing chamber 45 assist in directing the ball 65 to the port 43. With the bottom-most facing exhaust port 43 blocked, the highly pressurized chemicals are forced to exit the upper-most facing exhaust port 43, projecting the mixed chemicals vertically (and preferably up to face level), where they are ignited, enhancing the stunning and disorienting effect of the blast. Experimentation has determined that under these conditions, a brass ball 65 makes a secure press-fit into a steel or aluminum grommet or cringle 46 lining the perimeter of each exhaust port 43. Advantageously, the device 10 provides a directional vertical deployment of explosive chemicals with nearly every application.

In other embodiments, the ports 43 are eliminated. In one such embodiment, the energetic mix is ejected parallel to and in line with powder reservoirs for certain reloadable cartridge applications, for example, for use on bang poles, drone UAVs, and "throwbot" attachments.

G. Ruggedized Tie Rods

Bores 61 are provided through the bulkhead 42 of the reusable compartment 12, along the length of the disposable compartment 14, and—in embodiments which include it—through the end cap 16 for receiving high-strength fasteners, such as tie rods 60. The tie rods 60 (also referred to as "connection rods") are selected of sufficient diameter and strength—e.g., a high-carbon steel, chromoly-hardened steel or an at least equally strong material—to withstand the force of the initiator 54-driven detonation, including the partial detonation of any residue of explosive chemicals within the disposable compartment 14 and mixing chamber 45 that is not entirely ejected prior to detonation. Counterbores (not shown) for recessing heads of the tie rods 60 or nuts for the tie rods 60 are also defined in the end cap 16. In one implementation, two separate sets of tie rods 60 are provided, one to connect the bulkhead 42 of the reusable compartment 12 to the disposable compartment 14, and another set to connect the end cap 16 to the disposable compartment 14. In another implementation, a single set of tie rods 60 are used to join all three compartments.

The present invention encompasses both hand-thrown and launchable chemical agent delivery receptacles 10. The drawings illustrate a hand-thrown embodiment of the chemical agent delivery receptacle 10 that includes not only a case or body 11 as described above but also manual activation and safety elements that mimic elements found on a conventional grenade. Advantageously, mimicking conventional features increases the comfort and confidence that law enforcement and military personnel are likely to have with the device 10.

H. Spoon, Striker and Power Switch

Accordingly, in one embodiment of the invention, the chemical agent delivery receptacle 10 includes a locking pin 30 (also referred to as a "safety pin" or a "pull pin") attached at one end to a pull-ring 24, a safety lever 26 (commonly known in military circles as a "spoon"), and an arm 25 (commonly referred to as a "striker" or "hammer") strongly loaded by a torsion spring 37. The locking pin 30 extends through the reusable compartment 12, locking the striker 25 and lever 26 in place. In particular, the locking pin 30 holds the spring-loaded striker 25 in a position that blocks it from striking the terminals 27. A groove or notch 34 in the locking pin 30 engages a projection 39 in the striker 25, raising a threshold of force required to remove the pull pin 30 from the device 10, and displacing the need for the typical single use cotter pin found in conventional grenades. This concept allows accurate control of the pull force and is re-usable over the life of the device 10. The pull-ring 24 can be latched into ring seats 28 formed in the flat sides of the reusable compartment 12 to keep it from rattling.

In one embodiment, the safety lever 26 comprises columnar-based engineered plastic. The top section 32 of the safety lever 26 is received within a channel 34 in the top of the reusable cartridge 12 and extends transversely to a thumb tab 36. The thumb tab provides a tactile reference of a top side of the device 10. From the thumb tab 36 a lower section 38 of the lever 26 extends longitudinally along a channel 35 in the outer surface of compartments 12 and 14. A magnet 68 is embedded into the long arm of the lever 26, the magnet 68 serving to hold the lever 26 to the channel 35 running down the side of the device 10. The magnet 68 also serves an important safety function—the prevention of detonation if "milking" of the device 10 is observed—which is discussed further below.

Like a conventional grenade spoon, the safety lever 26 is arranged on the case 11 to hold the spring-loaded striker in a blocked position after the pin 30 is removed for as long as the safety lever 26 is grasped against the case 11. After the grasp is released, the spring-loaded striker 25 ejects the safety lever 26, swinging it around the fly-off pivot 62 and away from the case 11. The striker 25 then strikes an element that starts a chain reaction to detonation of the explosive agents. In a non-digital embodiment, the element is a primer. (Although the primary focus of this application is upon digital embodiments, there are novel structural aspects—such as the use of two exhaust ports 43 and a ball 65 to block one of them—that can be applied advantageously to non-digital embodiments).

Figure 3:
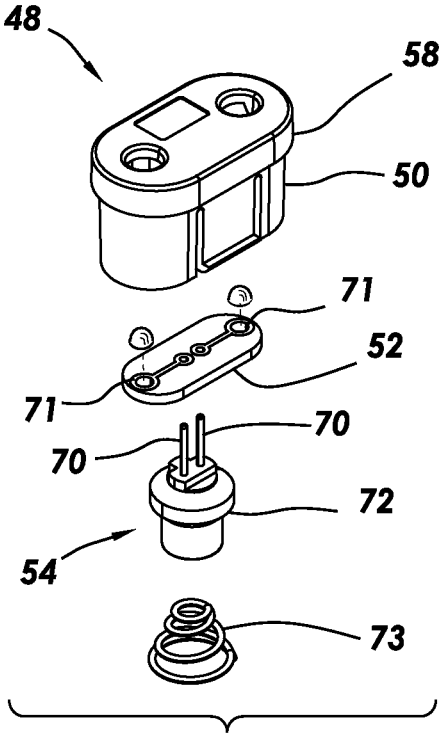
FIG. 3 is an exploded view of an electrically activated initiator of the delivery device.
Figure 4:
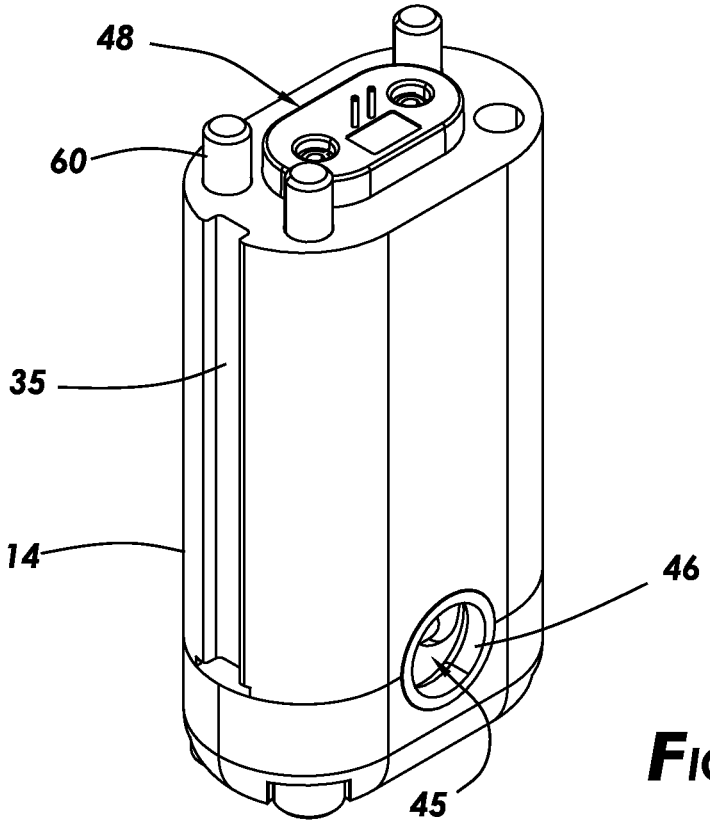
FIG. 4 is a perspective view of a disposable cartridge of the delivery device.
Figure 5:
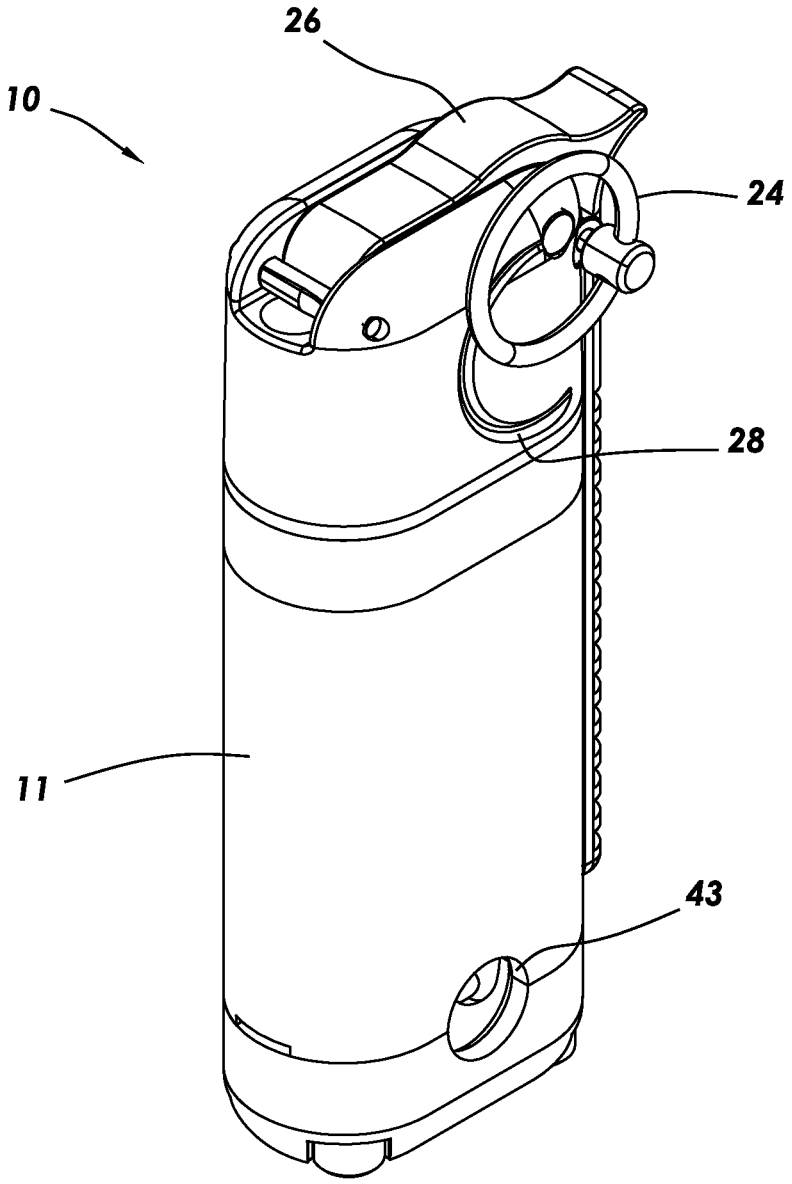
FIG. 5 is a front perspective view of the delivery device when assembled.
Figure 6:
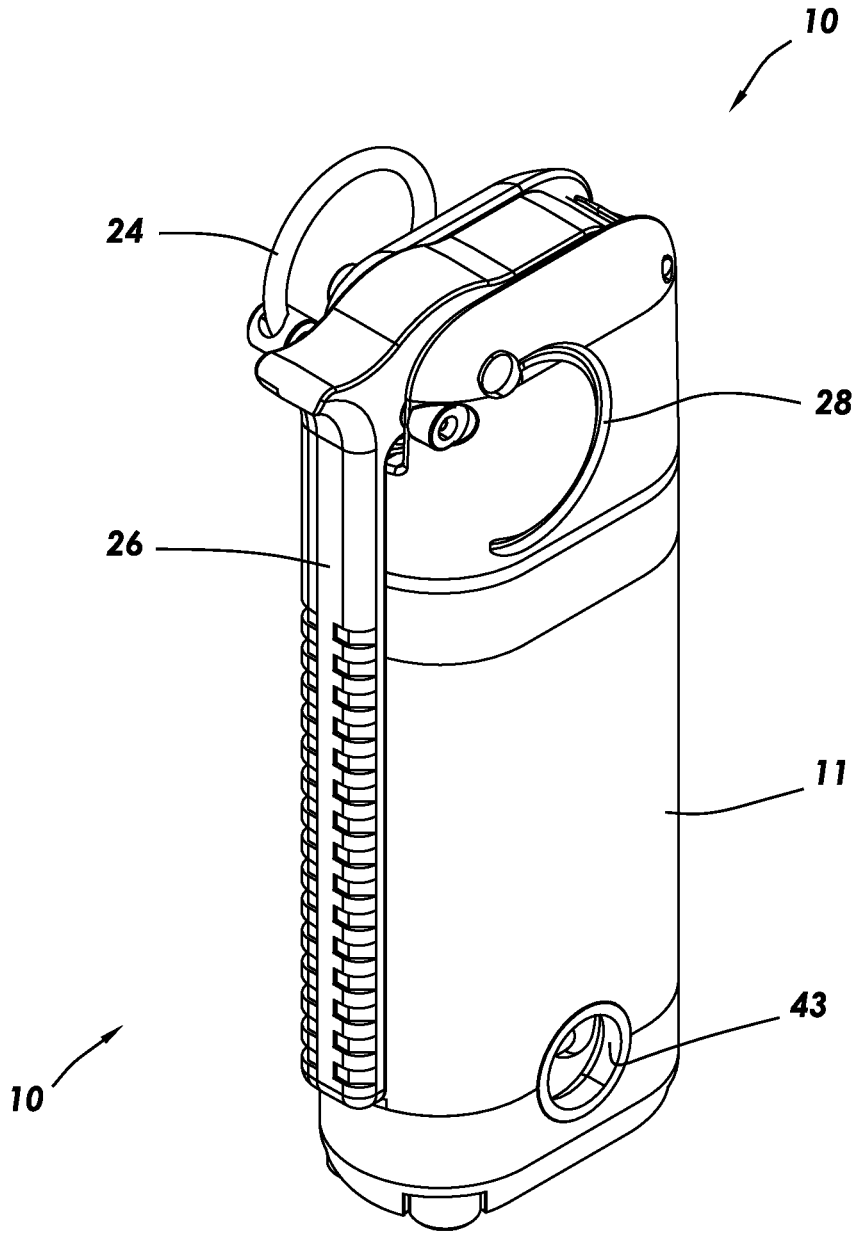
FIG. 6 is a rear perspective view of the delivery device when assembled.
Figure 7:
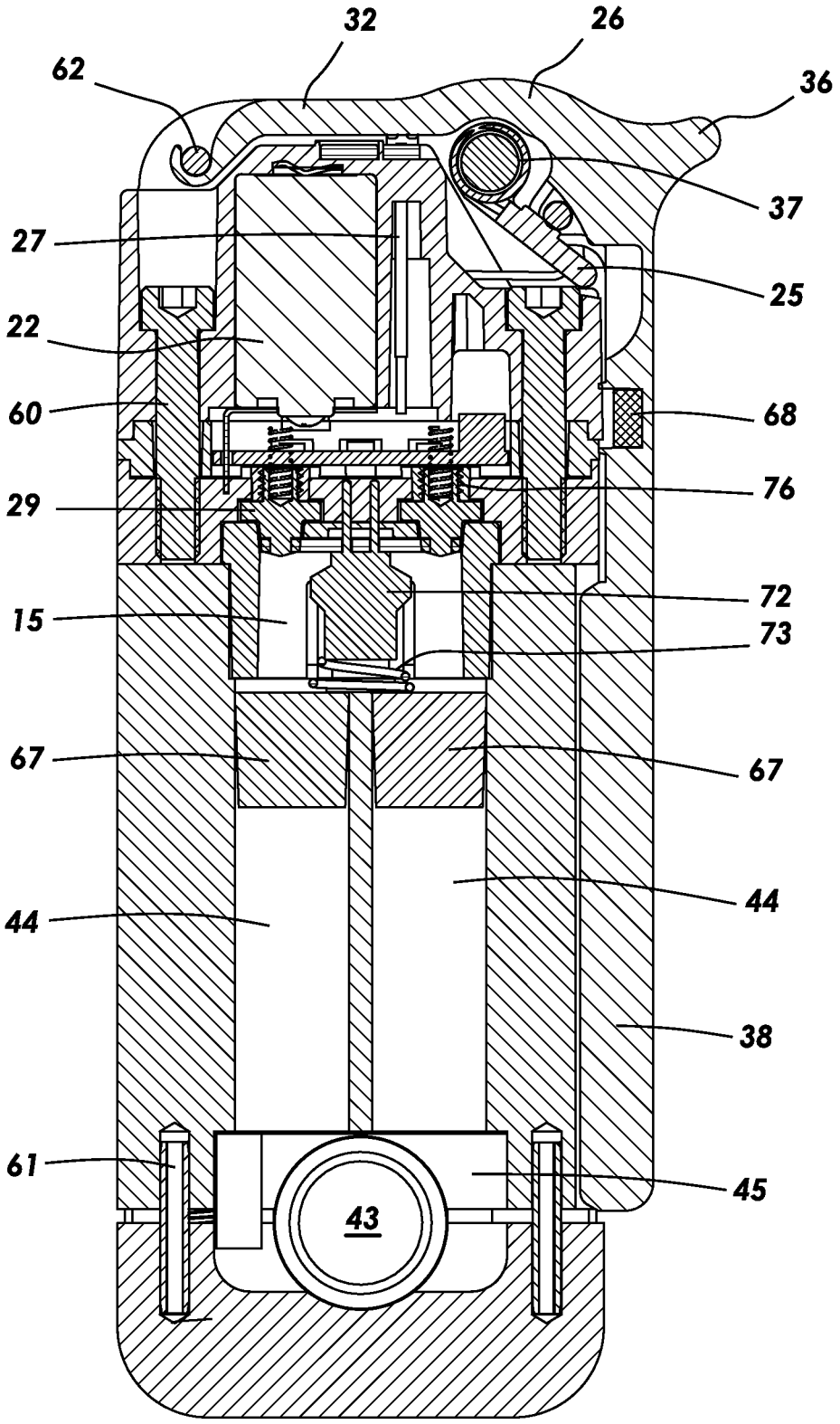
FIG. 7 is a cross sectional view of the delivery device taken along a plane parallel to and in between the delivery device's primary sides.
Figure 9:
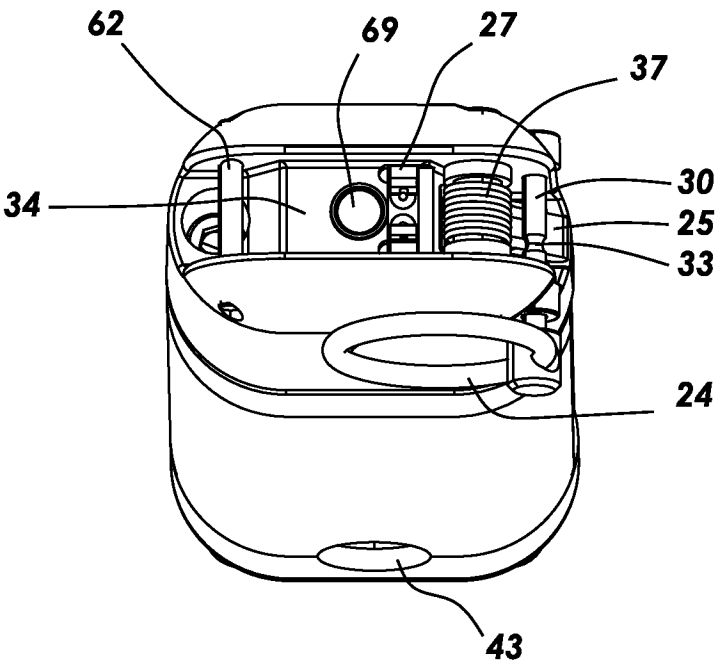
FIG. 9 is a top-side perspective view of the delivery device that illustrates a safety pin, spring, and magnet in the channel in the top of the delivery device.
Figure 8:
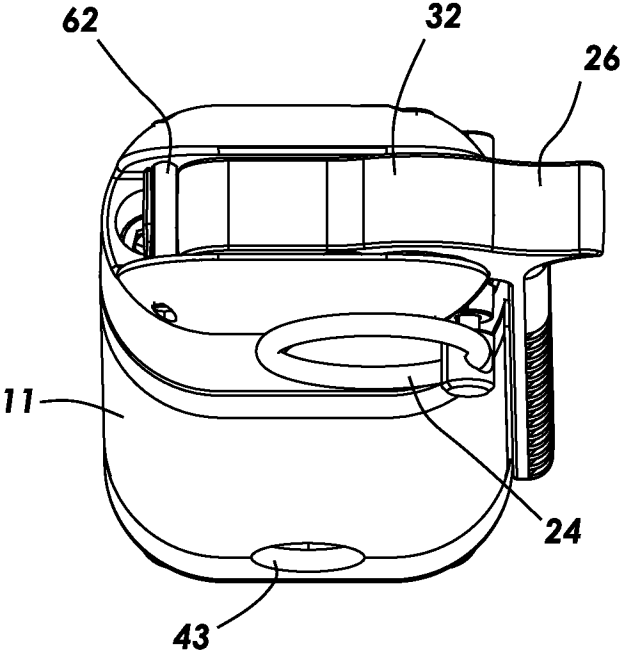
FIG. 8 is a top-side perspective view of the delivery device that illustrates a safety lever nested in a channel of the top of the delivery device.
Figure 10:
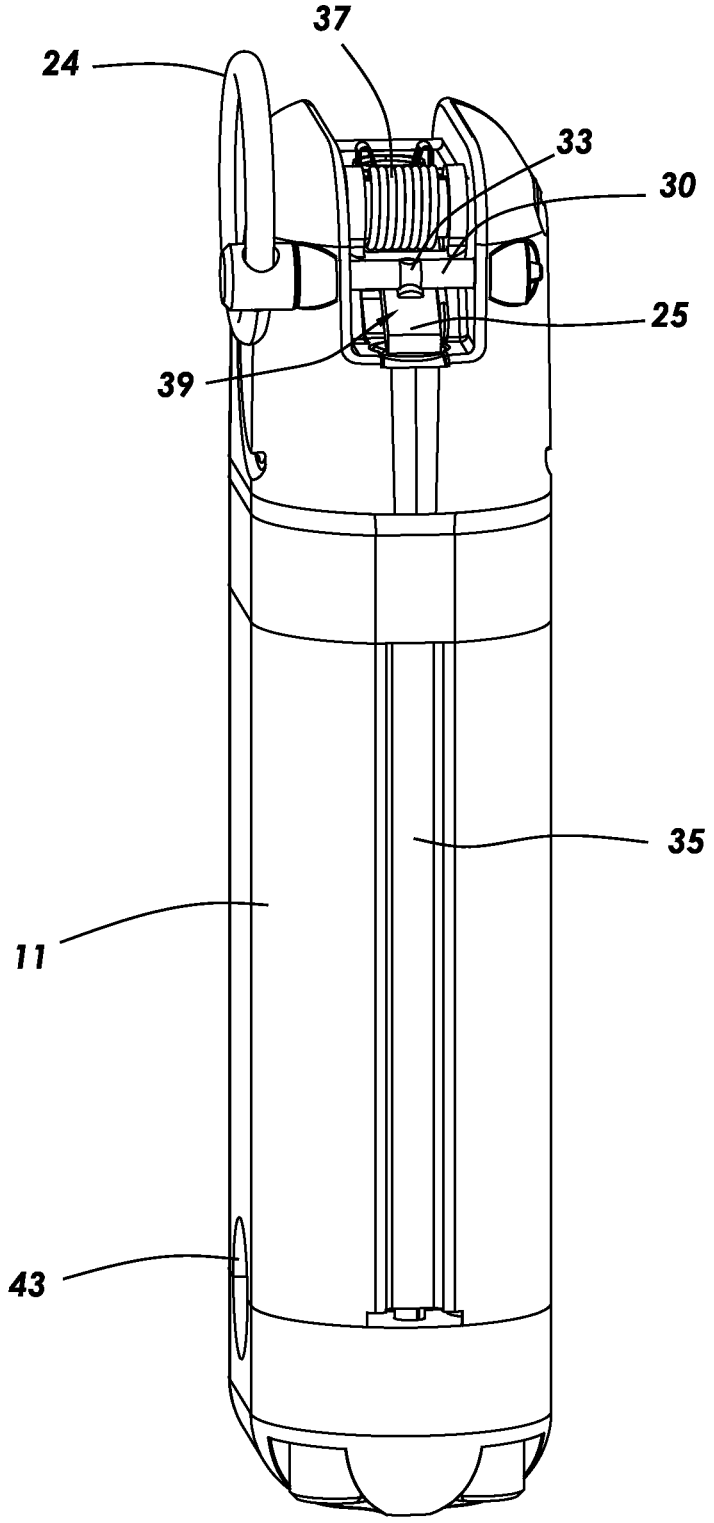
FIG. 10 is a side perspective view of the delivery device illustrating the spring-loaded striker and safety pin of the delivery device.

In a preferred digital embodiment, the element constitutes the two power terminals 27 of the power supply switch 19 that connects the detonation control circuit 18 to one of the battery 22 electrodes. The power supply switch 19, alluded to earlier during the description of the detonation control circuit 18, comprises terminals 27 (which have a pogo-stick appearance in FIG. 3) and a conductive bridge that is manipulable to close and open the circuit. In one implementation, the conductive bridge is the striker 25 itself, which is made of a conductive material such as nickel-plated steel. In another implementation, the conductive bridge is a conductive strip affixed to the striker 25.

As the spring load striker 25 strikes the power terminals 27, there is a conceivable risk of the striker 25 bouncing. To prevent or at least minimize such bouncing, a latching magnet 69 is arranged in a top of the reusable compartment 12 that latches the striker 25 to the power terminals 27 of the power supply switch 19.

It will be observed that the term "manually operated switch" encompasses this non-conventional combination of the striker 25 and the power terminals 27. In an alternative embodiment, the striker 25 and power terminals 27 are replaced with a more conventional switch conductively connected to the circuit board 20, such as a rocker, push-button, toggle, or slide switch. The use of the striker 25, however, has the advantage of leveraging the experience that many military and police personnel have with traditional grenades and/or stun grenades.

Advantageously, the inclusion of the power supply switch 19 the battery 22 is electrically disconnected from the electronics until the striker 9 and lever 26 are released by the user. This not only prevents the battery 22 from draining down and keeps the device 10 operational for a period approaching the shelf-life of the battery 22, but also improves the operational safety of the device 10.

II. DIGITAL CONTROL ARCHITECTURE

A. Digital Detonation Circuit

Figure 11:
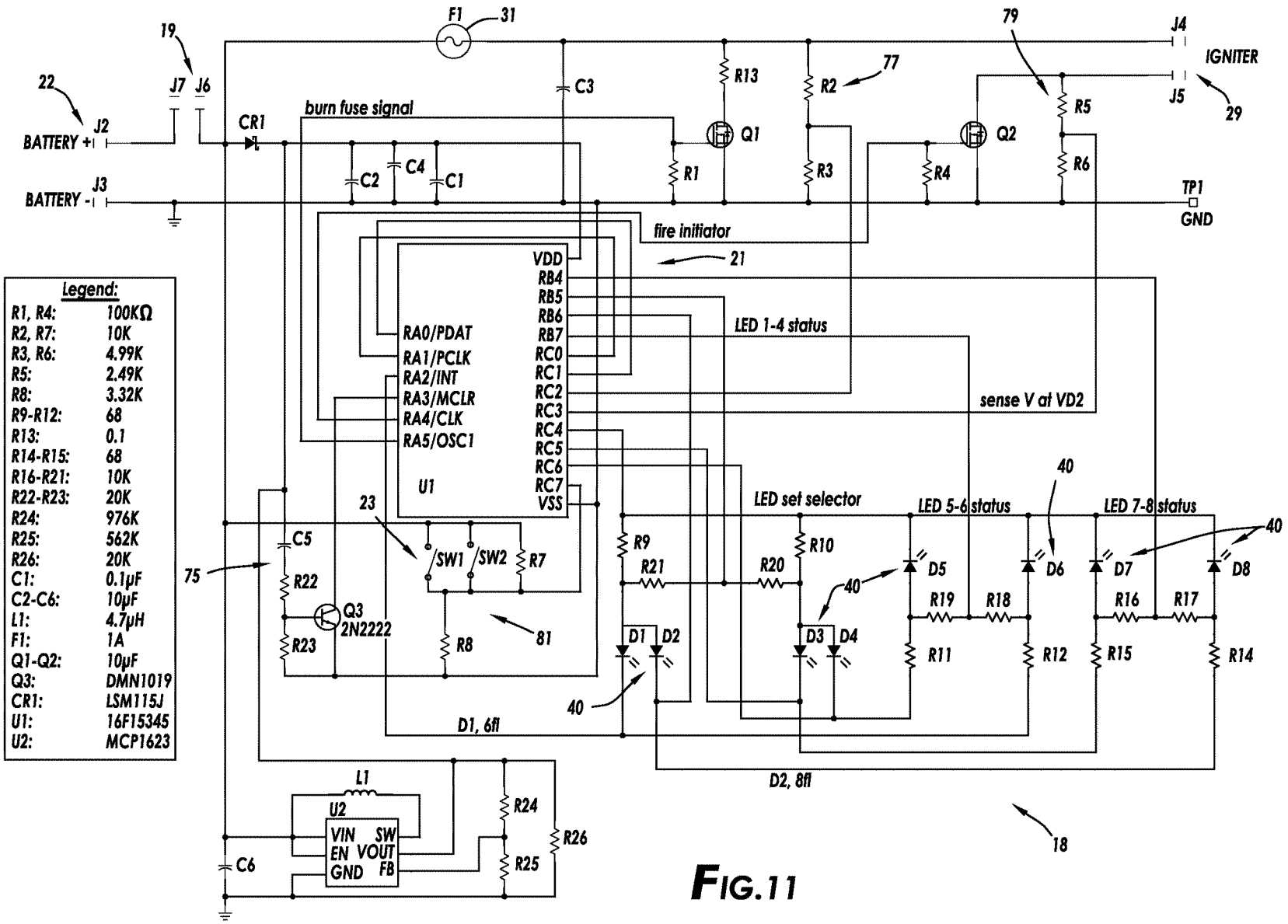
FIG. 11 is a diagram of one embodiment of a control circuit for the delivery device.

This description now shifts to a discussion of the electrical components and digitally controlled actions that complete a sequence between closure of the power supply switch 19 (i.e., the striker 25 striking the power terminals 27) and activation of the initiator 54. The brains of the device 10 is the detonation control circuit 18, which—as illustrated in FIG. 11—comprises a digital controller such as a microprocessor 21 and several other components.

The microprocessor 21 includes a clock, non-volatile on-chip memory for firmware and data, a central processing unit to execute the firmware, a master reset pin, and a plurality of both digital and analog pins for assessing signal inputs from various circuit elements and driving a plurality of transistors and signaling LEDs. In one embodiment, the microprocessor comprises a Microchip Technologies®'s PIC16F15344 chip, which provides ample pins for sensing voltages at various voltage dividers and for driving the transistors and LEDs.

Another component of the detonation control circuit 18 is an impedance-reactance delay element 75 between the positive electrode of the battery 22 and the master reset pin RA3/MCLR of the microprocessor 21. As explained in the next section, the impedance-reactance delay element 75, which comprises a resistor and reactive element (i.e., capacitor or inductor), interposes an analog delay between power being applied to the microprocessor 21 and the microprocessor 21 waking up.

Two more significant components of the detonation control circuit 18 are a slow-burn fusible link 31 (F1) (or, in an alternative embodiment, a circuit breaker) in the electrical path between the microprocessor 21 and the initiator 54 and a fuse activating transistor Q1 to create what is approximately a short circuit (connecting the voltage to a 0.1Ω resistor). By gating the transistor Q1 on, the microprocessor 21 is able to burn the slow burn fusible link 31, rendering the circuit 18 unable to fire the initiator 54 and therefore safe.

Another component of the detonation control circuit 18 is a proximity detector, such as one or more reed switches 23 (SW1 and SW2) connected to pin RC7 of the microprocessor 21. The reed switches 23 are closed by the presence of a magnetic field. In the illustrate embodiment, pin RC7 of the microprocess is connected to a junction between resistors R7 and R8 of a third voltage divider and detect the voltage there. If either of the reed switches 23 closes, it shorts the path around resistor R7, raising pin RC7 to high. With this structure, the microprocessor 21 detects whether the magnet in the lever is proximate to the case, and, if it is proximate after the power source has been connected to the control circuit, prevents digital activation of detonation of the one or more explosive agents. Persons of ordinary skill in the art will recognize structurally equivalents to reed switches and magnets, including contact switches and non-contact proximity sensors such as those described in Wikipedia's "proximity sensor" article, which is herein incorporated by reference as of this application's filing data, for use as a proximity detector.

Provided that the fuse 31 is intact, the microprocessor 21 is able to fire the initiator by driving pin RA4 high to gate transistor Q2, which drives the negative electrode of the initiator 54 to ground.

In the illustrated embodiment, the microprocessor 21 uses five pins to drive eight LEDs D1-D8. LEDs D1 and D3 are yellow LEDs, D2 and D4 are green LEDs, and the remaining LEDs D5-D8 are red LEDs. One pin (e.g., RC4) acts as an LED set selector, enabling either LEDs D1-D4 or LEDs D5-D8, but not both sets, to turn on. Another pin (e.g., RA2) can be asserted in rapid or slow alternating fashion to flash either a yellow LED (e.g., D1) or one of the red LEDs (e.g., D6), depending on which LED set has been enabled. A third pin (e.g., RB6) can be asserted in rapidly alternating fashion to flash either a green LED (e.g., D2) or a different red LED (e.g., D8), again depending on which LED set has been enabled. Fourth and fifth pins (e.g., RC5 and RC6) can be asserted in rapidly alternating fashion to flash other of the LEDs. Values for resistors R9-R12 and R14-R15 are selected to be relatively low, thereby causing the LEDs to emit bright light.

The circuit 21 is also configured to enable the microprocessor 21 to test the LEDs prior to firing the initiator 54. Three pins—RB5, RB7, and RB4 respectively—are provided to send a small current to LEDs D1-D4, D5-D6, and D7-D8, respectively—through relatively high-resistance resistors R16-R21, insufficient to produce much light (which conserves the energy of the battery 22) but sufficient to test the integrity of the LEDs.

The circuit 21 also includes a low-voltage input boost regulator U2 that provides several benefits, including filtering out hammer bounce. In one implementation, boosts an input voltage of as low as three-quarters of a volt to about 3.6 volts. In this implementation, the battery 22 is a 3V battery, and the microprocessor 21 requires 2.4V. Boosting the voltage to about 3.6V provides headroom that protects the microprocessor 21 from brownouts. Front-end reactance in the circuit also helps to hold the voltage at a level sufficient for the microprocessor to carry out its tasks. This improves performance of the device 10 across conditions including cold temperatures and aging or partially depleted batteries. LED light output also benefits, as the LEDs can be operated at a slightly higher voltage.

In one embodiment, a multiple-pin connector or socket (not shown) is wired into the board 18 that is connected to the power, ground, clock, and at least one data inputs of the microprocessor 21. This connector enables an external device to connect via serial port to the board, program the microprocessor 21, configure it with firmware, and read out history and diagnostic data from the microprocessor 21.

B. Safety Checks

Figure 12:
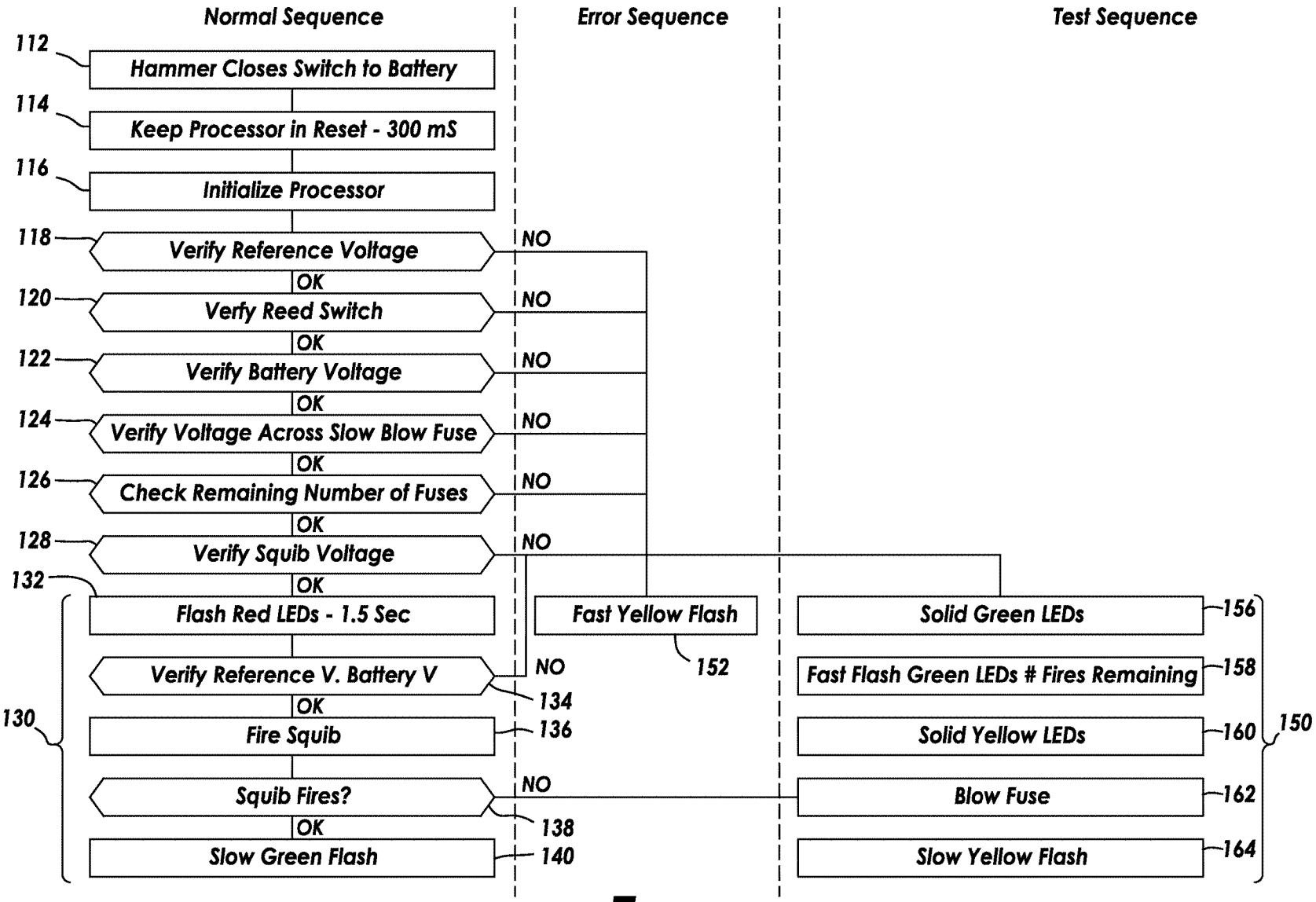
FIG. 12 is a flow chart of a safety check sequence, a detonation sequence, and a render safe sequence of the delivery device.

FIG. 12 illustrates a sequence 110 that happens after the circuit 18 is powered up. In block 112, current begins to flow from the battery 22 to the circuit board 20. In block 114, activation of the microprocessor 21 is delayed by the time it takes to charge a charge capacitor (in FIG. 11, capacitor C5) in an RC delay element 75 of the circuit 18 placed between the positive electrode of the battery 22 and the master reset pin RA3/MCLR of the microprocessor 21 to a level sufficient to switch the state of the master reset input. The RC delay element 75 comprises a switching transistor Q3 in combination with a capacitor C5 and a resistive voltage divider made up of R22 and R33. The voltages at nodes between the capacitor C5 and resistor R22 and between resistors R22 and R23 rise logarithmically when power to the circuit 18 is switched on. When the voltage at the noted between resistors R22 and R23 reaches a switching threshold for transistor Q3, the transistor state is switched, changing the state at the reset pin and enabling the microprocessor to begin a sequence of operations to activate the initiator.

In one embodiment, values for the capacitance and resistance are selected to impose about an analog, non-microprocessor-dependent 300 ms delay (which may vary according to temperature), and preferably at least 200 ms. (The amount of analog delay may vary significantly depending on temperature). This reduces the risk of injury in the event of a catastrophic failure of the circuit 18 that fires the initiator as soon the microprocessor 21 is active. Without this safety feature, there is a risk that the device 21 would detonate in the vicinity of the user throwing it were this catastrophic failure to occur. Advantageously, the analog delay feature is not dependent on the integrity of the microprocessor 21, so the device 10 should be several feet away by the time the microprocessor 21 is even awake.

In block 116, the microprocessor 21, which no longer has its master reset pin held low, is initialized. The microprocessor 21 begins to perform a sequence of safety or integrity checks 118-128 on components of the device 10. If the microprocessor 21 receives satisfactory results from each of the safety checks 118-128, then a firing sequence 130 begins.

In block 118, the microprocessor 21 checks an internal reference voltage inside the microprocessor. In one implementation, the internal reference voltage is related to the boosted voltage provided by the low-voltage input boost regulator U2. The reference voltage is compared to other sensed voltages as part of the safety-check sequence In block 120, the microprocessor 21 checks one or more reed switches 23 (SW1 and SW2 in FIG. 11 to determine whether a magnet 68 embedded in the safety lever 26 is proximate. If the microprocessor 21 detects that the magnet—and therefore the safety lever 26—is still proximate, then there is a possibility that the user holding the device 10 is "milking" it by alternately squeezing and relaxing the safety lever 26. This kind of phenomenon may occur when the user is nervous, stressed, obsessive-compulsive, or has a tic. In prior art devices, this can result in the device going off while it is still in the user's hand, causing injury or death. Advantageously, when this safety check detects such a condition, the microprocessor 21 blocks the firing, instead causing the microprocessor 21 to enter the termination sequence 150, which causes the device 10 to flash yellow LEDs and burn through the fuse 31 to render the device 10 safe.

In block 122, the microprocessor 21 verifies the battery voltage through RA7 pin, which if the reed switches 31 are open, is connected to the junction between resistors R7 and R8 of voltage divider 81. If the battery voltage is below a safe-firing-voltage threshold, there is risk that the battery be able to supply an amount of current necessary to set off the initiator, but over a longer, unpredictable length of time. If the battery voltage falls below the safe-firing-voltage threshold, then the microprocessor 21—which is able to operate on a lower current than that which is required to fire the initiator 54—blocks the device 10 from firing. This too causes the microprocessor 21 to enter the termination sequence 150.

In block 124, the microprocessor 21 verifies the fused voltage using a voltage divider 77 comprising two resistors R2 and R3 and a junction between them that is connected to the RC3/ANC3 pin of the microprocessor 21. If there is no voltage, this signals that the 1A fuse or fusible link 31 has blown, in which case the microprocessor 21 initiates the termination sequence 150.

In block 126, the microprocessor 21 checks internal nonvolatile memory to determine the number of remaining uses (firings) of the reusable cartridge 12. In one embodiment, the microprocessor 21 is initially programmed to provide up to eighteen uses. Which each use, this number is decremented, and when the number of remaining uses reaches zero, the microprocessor 21 initiates the termination sequence 150.

In block 128, the microprocessor 21 verifies the presence of the initiator 54 by the checking the voltage in the middle of voltage divider 79, whose high resistance resistors R5 and R6 allow a small amount of current to flow through the activation terminals 29, but not enough to detonate the initiator 54. If the initiator 54 is not there, or if it is there but has already detonated, an open circuit will exist at the activation terminals 29 and no voltage will be detected. In this case, the microprocessor 21 initiates the termination sequence 150.

To summarize, the microprocessor 21 requires satisfactory results from these various safety checks, or it will prevent firing of the initiator 54. Advantageously, the microprocessor 21 can perform these safety checks in as little as 60 μs. If any of these tests fail, this indicates a general failure in an attempted detonation (analogous to a grenade being a "dud"), causing the circuit to invoke the termination and render-safe sequence 150.

It will of course be recognized that different embodiments of the circuit 18 could use different pinout connections, different microprocessors, and different architectures, including FPGA.

C. Render-Safe Sequence and LED Messages

The termination sequence 150 includes a series of LED messages and the blowing of the fuse or fusible link 31, which disables the device 10 and renders it safe. In a preferred embodiment, the fuse or fusible link 31 is not easily replaceable, but rather requires servicing by a technician trained and equipped to inspect the components of the reusable compartment 12 and determine whether it can be safely reused again.

In block 152 of the termination sequence 150, the microprocessor 21 causes the yellow LEDS 40 (e.g., D1, D3) to flash rapidly. In block 156, the microprocessor 21 simultaneously causes the green LEDs 40 (e.g., D2, D4) to light up solid (i.e., without flashing) for a first period of time. Then, in block 158, and for a second period of time, the microprocessor 21 causes the green LEDs 40 (D2, D4) to flash rapidly to indicate the number of remaining uses. The microprocessor 21 is programmed to allow a total of n further reuses of the reusable compartment 12 of the flash diversion device 10, and to decrement n after every use; and in a test mode, the circuit causes one of the LEDs to flash said n number of times, signaling the number of reuses left.

In block 160, the microprocessor 21 causes the yellow LEDs to light up solid for a third programmable period of time, such as thirty seconds. Unless the reusable compartment 12 is mechanically reset within this third period of time, then in block 162, the microprocessor 21 applies a voltage to the gate of MOSFET transistor Q1, connecting the fuse or fusible link 31 to ground through a small, 0.1Ω resistor. This allows a significant amount of current to flow through the fuse or fusible link 31, which blows the fuse or fusible link 31 and renders the device 10 safe. This is then followed in block 164 by a slow yellow flash, which indicates that the device 10 has been rendered safe and is safe for personnel to pick up. This provides a significant advantage over non-digital grenades. The U.S. Military has a protocol requiring personnel to wait a long period of time—such as 45 minutes—before going near a dud grenade to retrieve and safely dispose of it. With the present device 10, personnel need wait only 30 seconds (or whatever the third period of time is programmed to be) before retrieving the device 10.

The firing sequence 130 comprises a delay, the flashing of several red LEDs 40 (D5-D8), firing of the initiator 54, verifying the firing of the initiator 54, and providing a status check. In block 132, the microprocessor 21 flashes at least one pair and preferably two pairs of red LEDs 40 (e.g., one pair on each major side of the case 11) that are displaced from one another in an alternating sequence that in one embodiment resembles the alternating red lights of a railroad crossing gate. Railroad crossing gate lights generally flash at 45-65 times/second. Preferably, the red LEDs 40 are programmed to flash at a similar or greater frequency, e.g., 45-180 times/second. The lights are attention-grabbing, causing persons within the vicinity to set their gaze on it, which increases the blinding effect of the blast. In one embodiment, the red LEDs 40 flash for a programmable period of time such as 1.5 seconds. The specific time delay can be programmed at the factory to the end user's exact specification and is accurate to within a few milliseconds. The total delay between mechanical activation and the firing of the initiator 54 is approximately equal to this programmable period plus the initial RC circuit analog delay.

In block 134, the microprocessor 21 again verifies the reference voltage and battery voltage. If these do not fall within spec, then in block 152, the microprocessor 21 slowly flashes one or more yellow LEDs 40 (e.g., D1, D3), signaling a failure during which the microprocessor 21 immediately shorts the fusible link 31 to render the device 10 safe.

In block 136, the microprocessor 21 applies a high current to the initiator 54 to fire the initiator 54. Afterwards, in block 138, the microprocessor 21 again attempts to apply a small current to the activation terminals 29. If the initiator 54 has fired, then there will, in all probability, be an open circuit at the activation terminals 29, preventing the attempted current flow. The microprocessor 21 interprets an open circuit as indicating a successful firing of the initiator 54, and flow proceeds to block 140. If, on the other hand, the initiator 54 has not fired, then in block 152, the microprocessor 54 causes a yellow LED 40 to flash slowly, signaling a device failure during which the microprocessor 21 immediately shorts the fusible link 31 to render the device 10 safe.

In general, flashing red lights signify danger, e.g., that full detonation is imminent, fast flashing yellow means that the device 10 is blowing or has blown through the fuse 31, and slow flashing yellow means that the device 10 is rendered safe to retrieve. Green LEDs 40 (e.g., D2, D4) are used to indicate status.

III. SEQUENCING ISSUES, DEPLOYMENT AND OPERATION

A. Sequencing the Initiator and Flash-Bang Detonations

The initiator 54 disperses the fuel/air or other chemical mixture by ejecting the energetic materials from the device 10 vertically to form a fine dust cloud where the composition is atomized in free space. Subsequently, a high temperature heat source, which may be from the initiator or a separate igniter, is applied to the dust cloud to initiate a chemical reaction that results in high speed combustion or an explosive event. A commercial, DOT-compliant airbag initiator 54 naturally supplies enough heat to ignite the mixture when used in conjunction with device 10.

It is important that the expulsion of the mixture and the ignition of the mixture be sequenced with enough of a delay to prevent premature ignition of the mixture while being timely enough to avoid dispersing the mixture so much or so far away from the device 10 that the mixture can no longer be ignited. Preferably, the mixture is entirely or almost completely (i.e., at least 95%) expelled through the top-most facing outlet port 43 before being ignited, minimizing impacts to and warm-up of the device 10. Ideally, the case 11 is only warm to the touch after the flash-bang, enabling personnel to retrieve the case almost immediately after deployment.

In one embodiment, this careful sequencing is accomplished by putting a barrier, such as one or two "pistons" (very loosely defined) between the chemical(s) and the initiator. The pistons 67 temporarily isolate the chemicals from the flame wave front or fireball, delaying ignition until the pistons 67—preceded by the chemicals themselves—are expelled from the reservoirs 44. Depending on the material and structure selected for the pistons 67, this gives the chemicals a short period of time to mix in the mixing chamber 45 and to almost completely discharge from the topmost-facing outlet port 43 before the flame front exits the port and ignites the chemical cloud.

In the development of the present invention, cork was discovered to make a very suitable piston 67. When the initiator 54 goes off, the powerful overpressure wave rapidly pushes the cork down the reservoirs 44 and then disintegrates the cork in the mixing chamber 45, ensuring that most of the chemicals are discharged from the outlet port 43 prior to being ignited. The cork temporarily shields the chemicals from the heat of the blast. Then, the cork—which is frangible—rapidly disintegrates, ensuring that the heat emanating from the initiator blast reaches the mixture in a timely fashion before the mixture is too far away or diffuse to ignite and before the heat pulse itself dissipates and cools too much. Timing can be roughly calibrated by adjusting the tightness of fit, length, density, and integrity of the cork.

It has also been discovered that the use of frangible hermetic seals 64, such as a very thin aluminum, at the bottom of the reservoirs 44 is advantageous. It is believed that this enables the initiator 54 to momentarily compress the chemicals before the seal 64 is broken, resulting in improved mixing of the chemicals in the mixing chamber 45 before they are expelled through the outlet port 43. This benefit is in addition to the frangible seal's purpose in keeping the chemicals contained in the reservoirs 44 prior to detonation.

The process is safer because the chemical composition is not premixed but mixed only after the device 10 is deployed. As the reaction occurs entirely outside the device 10, the housing or case post-detonation temperature is only warm to the touch.

B. Deployment and Operation

To deploy the device 10, the locking pin 30 is removed and then the device 10 is thrown, releasing the safety lever 26 as the user lets go. The spring-biased striker 25 then ejects the safety lever 26 and connects the power terminals 27, connecting power to the digital detonation circuit 18. In other embodiments, the digital detonation signal is triggered wirelessly, incorporated into a sequenced patterned deployment, or triggered on impact using an accelerometer. After the microprocessor 21 performs a series of tests, and those tests indicate device 10 readiness, the microprocessor 21 sends an electronic activation signal (such as a high current pulse) to the initiator 54. This burns the bridgewire 70 of the initiator 54 and detonates the propellant 72 that surrounds it, resulting in a high-pressure blast wave that expels chemicals in the reservoirs 44, mixes them in the mixing chamber 45, and shooting them through an outlet port 43 into a vertical plume extending about 5-8 feet high and about 6 feet wide. Meanwhile, the high-pressure blast wave disintegrates the pistons 67, allowing the heat of the initiator detonation to ignite the mixture after most of the mixture has shot through the outlet port 43. The mixture, once ignited, generates an extremely bright (e.g., 8-10 million candela) and extremely loud (e.g., 175 dB) flash-and-bang event that is at the same time extremely brief (e.g., 8-12 ms), which is too quick in all but extreme circumstances to start fabric or carpet on fire.

IV. OTHER EMBODIMENTS

A. Training Embodiment

A training embodiment of the device 10 has a nearly identical form factor as the device 10 illustrated in the drawings. It is subdivided into a very similar reusable compartment 12 and a functionally distinct reusable training cartridge 14. The training cartridge 14 has the same or similar form factor and a same or similar top side, but unlike a field-operational dual-reservoir device 10, the training compartment 14 provides a single empty chamber in place of two reservoirs 44. The air-bag initiator 54 by itself, when detonated, produces a loud bang on the order of 130-140 dB. In the alternative, the training compartment 14 provides a reservoir 44 filled with a less volatile chemical, such as flour, to create a visible dust cloud along with pistons that minimize the risk of ignition of the white dust cloud created by the pressure blast.

B. Lethal Embodiment

A lethal embodiment of the device 10 includes BB's or other fragments or shrapnel that are either stored with the one or more chemicals or stored in a separate reservoir 44. Another lethal embodiment of the device 10 comprises forming some portion of the disposable cartridge 14 and/or end cap 16 to be fragmentable.

C. Wireless Control Embodiment

The illustrated embodiments of the device 10 provide enough spare room in the digital control compartment 12 to accommodate embodiments that incorporate other circuit elements, such as a Bluetooth, WiFi, RF, IR or other standard or military communications module or geolocation aids such as a GPS module. One significant application of a communications module is serialization, inventory control and management. Inventory control equipment can automatically read the serialization data for each GPS module to keep track of the device's handling and storage. In another embodiment, a communications module is used to implement an electronic leash. If the device 10 gets separated from its intended user, or is lost, by being out of range of intended user, the device 10 is disabled. Such devices 10 can be drone mounted and remotely driven. A wireless communications module also supports sequencing of many devices 10, which are staged and programmed to go off in a customizable sequence using a smart phone app.

Another application of the wireless control embodiment is to adapt the device 10 for use on a long pole known as a "bang pole." Officers sometimes use bang poles to break a window and shove a grenade into a room. The wireless control embodiment would enable the device 10 to be used in the same manner.

In each of these embodiments, the detonation control circuit 18 or the wireless receiver module is configured to receive and authenticate signals from the wireless receiver to mix and then detonate the two or more explosive agents.

D. Vehicle-Delivered Embodiment

As noted earlier, the present invention contemplates vehicle carried embodiments of the invention. The land, air, sea or space-based vehicle carries the case 11 along with a vehicular control circuit that controls vehicular movements of the vehicle.

In some embodiments, the case 11 is fixedly secured to the vehicle, which may be a rover, a boat, a drone aircraft, or a space transporter. In such a case, the vehicle is sufficiently ruggedized and/or sophisticated to survive the blast and recover from the recoil resulting from the initiator igniting and a detonation event occurring. Advantageously, in such embodiments the digital compartment 12 can be returned with the vehicle to base, enabling it to be reused.

In other embodiments, the vehicle carries a releasable fastener or launcher that is digitally controlled via the vehicular control circuit. The vehicular control circuit is configured to operate the releasable fastener or launcher to release or launch the case 11 in order to separate it from the vehicle prior to detonation.

In one embodiment, a rover is equipped with a triggerable spring-loaded launcher, the vehicular control circuit is configured to trigger the spring-loaded launcher prior to detonation of the one or more explosive chemicals.

In another embodiment, a drone aircraft is configured to carry the case 11 to a target, and an onboard vehicular control circuit is configured to release the fastener holding the case 11 in or to the vehicle, allowing the case to separate from the vehicle.

In another embodiment, the detonation activation circuit detects the separation of the case 11 from the vehicle and activates detonation of the two or more explosive agents a threshold of time after the detecting the separation.

In a further embodiment, the case 11 and a magnet exterior of the case are relatively positioned on the vehicular vehicle so that in an event in which the case 11 and vehicle fail to separate, the detonation control circuit 18 detects the presence of the magnet 69 via a reed switch 23 and prevents a programmed detonation.

In yet another embodiment, a GPS receiver is coupled to the control circuit 18; wherein the control circuit 18 is configured to receive GPS coordinates from the GPS receiver, compare them with target coordinates, and detonate the one or more explosive agents when the GPS coordinates and the target GPS coordinates match.

Vehicular embodiments also enable the device 10 to shoot down drones, balloons, and kites.

E. Different Sizes

The device 10 may come in any number of different sizes based upon customer requirements. In general, larger devices 10 will facilitate larger flash-bang events. Ergonomic factors including the weight and ability to comfortably hold and throw the device 10 will weigh considerably in the determination of a size for the device 10.

It will be understood that many modifications could be made to the embodiments disclosed herein without departing from the spirit of the invention. For example, a non-digital version of device 10 may use a striker-activated shock-sensitive primer that burns through a chemical delay fuse, which in turn ignites another propellant to expel chemicals from the reservoirs 44. As another example, other sensors such as level sensors and motion sensors could be added to the digital circuit, and the digital circuit programmed to condition and delay ignition of the initiator until and if the device 10 is determined to be level and at rest. Also, in a simplified embodiment of the device 10, the microprocessor 21 is replaced with a digital delay timer.

V. Recapitulation

Multiple embodiments of a chemical delivery device have been described that improve on one or more aspects of a conventional grenade or stun device. The following paragraphs recapitulate these concepts in terms that may add to or vary from the description hereto before.

In a first embodiment, a digitally controlled hand-tossable explosive delivery receptacle comprises a ruggedized reusable compartment enclosing a digital circuit and a disposable cartridge holding one or more explosive chemical agents and a primer. The disposable cartridge is configured to be mounted to the ruggedized reusable cartridge, and a high-strength bulkhead incorporated into the reusable or disposable compartment that separates the digital circuit from the explosive chemicals. The reusable compartment is sufficiently ruggedized to withstand the ignition of the primer and the detonation of the explosive chemicals to be reused with one or more additional disposable cartridges.

In a preferred implementation, the primer is selected to generate heat sufficient to detonate the explosive chemicals. The disposable cartridge has one or more reservoirs that store the one or more explosive chemicals prior to detonation and a primer port that provides a fluid passageway between the primer and the reservoirs. The digital circuit is configured to be manually activated by a person handling the receptacle and, when activated, to check for a set of conditions and ignite the primer when the conditions are met, consequently detonating the explosive chemicals.

In a second embodiment, a remotely activated grenade comprises one or more explosive chemicals, a primer selected to generate heat sufficient to detonate the explosive chemicals, a reusable compartment enclosing a digital cartridge, and a disposable cartridge that mounts to the reusable compartment. The disposable cartridge has one or more reservoirs that store the one or more explosive chemicals prior to detonation and a primer port that provides a fluid passageway between the primer and the reservoirs. The digital circuit includes a wireless communications module that is configured to receive wireless instructions and, in response to an ignition instruction, check for a set of conditions and ignite the primer when the conditions are met, consequently detonating the explosive chemicals.

In a third embodiment, a hand-tossable grenade comprises one or more chemical agents and an airbag initiator arranged in relation to the one or more chemical agents so that when the initiator is activated, it generates a pressure wave that expels the one or more chemical agents from the grenade.

LD.0102—Binary Explosive Grenade

In a fourth embodiment, a binary explosive hand-tossable grenade comprises a hand-holdable case, at least first and second reservoirs in the case that segregate components of a binary explosive prior to the grenade becoming a live grenade, an outlet port, and an initiator that, when activated, generates a pressure wave to expel the chemicals out of the first and second reservoirs and through the outlet port, wherein the chemicals are mixed as they exit the outlet port. In one implementation, the initiator is a commercial airbag initiator that not only produces a pressure wave but also ignites the mixture as or after the chemicals are discharged from the port.

In a fifth embodiment, a binary explosive grenade comprises a hand-holdable case, first and second reservoirs in the case that segregate components of a binary explosive prior to the grenade becoming a live grenade, an initiator, and first and second pistons placed in the first and second reservoirs, respectively, between the initiator and the components. The initiator, when triggered, generates a pressure wave to force the chemicals out of the reservoir. The first and second pistons are configured to push the chemicals out of the reservoirs in response to the pressure wave while temporarily shielding the chemicals from being ignited by heat generated by the initiator. In one implementation, the pistons are frangible and begin to disintegrate by the time they leave the reservoirs. More particularly, the pistons may be made of cork. In another implementation, the grenade further comprises a mixing chamber and one or more frangible seals between the reservoirs and the mixing chamber, so that before the initiator is activated the chemicals are contained between the pistons and the frangible seals. The frangible seals prevent the chemicals from mixing before the initiator is activated and are broken as the pressure wave forces the chemicals out of the reservoir and into the mixing chamber.

In a sixth embodiment, a tertiary explosive grenade comprises a case, at least first, second and third reservoirs in the case that segregate components of a tertiary explosive, an outlet port, and an initiator that, when activated, generates a pressure wave to expel the components out of the first, second and third reservoirs and through the outlet port, wherein the components are mixed as they exit the outlet port. An ignition source, which may be the initiator itself, ignites the mixture as or after the components are discharged from the port

LD.0103—Electrically Activated Diversion Device with Analog Delay

In a seventh embodiment, an electrically activated diversion device such as a flash-bang device comprises a case holding one or more chemical agents, an initiator, and a control circuit. The initiator is arranged in the case so that, when the initiator is electrically activated, the initiator generates a pressure wave that mixes, expels, and/or disperses the chemical agents. The control circuit is electrically connected to the initiator and configured to provide a current to the initiator to activate the initiator when a condition is met, such as power being applied to the control circuit and/or a safety condition being met. The control circuit includes a resistor and capacitor that, when power is applied to the control circuit, delays the control circuit's provision of current to the initiator.

In one implementation, the initiator is an airbag initiator. In another implementation, the chemical agents are components of a binary explosive. In an alternative implementation, the one or more chemical agents includes a lachrymator, a capsaicinoid, or noxious chemical agent.

In one implementation, the control circuit includes a digital controller such as a microprocessor, and wherein the condition is a determination by the microprocessor that it is safe for the initiator to be activated. Voltage at a node between the resistor and capacitor rises logarithmically when power to the control circuit is switched on. The microprocessor is prevented from running a sequence to activate the initiator until voltage at a node between the resistor and capacitor reaches a threshold. When the voltage across the node reaches a threshold, a state of the reset line is switched to enable the microprocessor to begin a sequence of operations to activate the initiator. Values for the resistance of the resistor and the capacitance of the capacitor are selected to create a delay of at least 200 ms between power being applied to the initiator and the voltage at the node crossing the threshold.

In an eighth embodiment, an electrically activated diversion device comprises a case holding one or more chemical agents such as a fuel and an oxidizer, an initiator, and a control circuit. The initiator is arranged in the case so that, when the initiator is electrically activated, the initiator generates a pressure wave that mixes, expels, and/or disperses the chemical agents. The control circuit, which is electrically connected to the initiator, is configured to provide a current to the initiator after a delay. At least a portion of the delay is provided by a resistor and a reactive element (i.e., a capacitor or inductor) that, when power is applied to the control circuit, interposes an analog delay between the application of power to the control circuit and the control circuit's provision of current to the initiator. In one implementation, the control circuit also comprises a digital timer—which may be incorporated into a microprocessor—that adds a digital delay to the analog delay between the application of power to the control circuit and the control circuit's provision of current to the initiator.

In one implementation, the control circuit conditions the control circuit's provision of current to the initiator on satisfaction of one or more safety conditions. For example, one embodiment of the electrically activated diversion device includes a hand-holdable safety lever pivotally coupled to the case and having an arm positioned along a side of the case. When the safety lever is pivoted past a threshold, power is applied to the control circuit. The control circuit may include a proximity detector that detects whether the arm has been returned to the side of the case, and if so, abstains from providing current to the initiator.

In a ninth embodiment, a chemical agent diversion device comprises a case, one or more reservoirs within the case to hold one or more chemical agents, an electrically activated initiator, a control circuit, and a plurality of LEDs arranged on the case. The electrically activated initiator is arranged in the case so that, when the initiator is electrically activated, the initiator generates a pressure wave that mixes, expels, and/or disperses the chemical agents. The control circuit is contained within the case and configured to interpose a delay between power being applied to the control circuit and activating current being supplied to the initiator. The control circuit is configured to switch on the LEDs to indicate an impending detonation of the device after power is applied to the control circuit. For example, in one implementation, the control circuit causes two spaced-apart LEDs to flash alternately prior to detonating the explosive agents, serving to draw attention toward the device prior to detonation of the one or more explosive agents.

In one implementation, the case is comprised of multiple separable compartments, including a first reusable compartment in which the circuit and LEDs reside. The control circuit is programmed to allow a total of n further reuses of the reusable compartment of the flash diversion device, and to decrement n after every use.

In another implementation, a fuse is provided in an electrical path that provides activating current to the initiator. The control circuit is configured to detect an anomaly and respond to a detected anomaly by blowing the fuse in order to disable the device.

LD.0104—Digitally Controlled Explosive Delivery Receptacle with Internal Safety Checks In a tenth embodiment, a digitally controlled explosive delivery device comprises a case, one or more reservoirs within the case to hold one or more explosive agents, an electrically activated initiator within the case for mixing and/or detonating the one or more explosive agents, a control circuit contained within the case that is electrically connected to the initiator, and a microprocessor in the control circuit that, when activated, performs a device integrity check that conditions initiator activation on satisfaction of one or more detectable conditions.

In one implementation, the microprocessor's device integrity check includes confirming that the initiator is connected to the control circuit. More particularly, the microprocessor confirms that the initiator is connected to the control circuit by attempting to apply a small current to a bridgewire of the initiator and detecting if there is a voltage.

In another implementation, the explosive delivery receptacle further comprises a spoon coupled to the case that, when gripped against the case after a restraining pin is removed, restrains a spring-loaded hammer from initiating a detonation sequence. A magnet is located in or on the spoon in proximity to a reed switch on the control circuit that detects the proximity of the magnet when the spoon is positioned against the case. The microprocessor, as part of its device integrity check, confirms the presence or absence of the magnet and prevents initiator activation if the magnet is detected. If the magnet is detected, the microprocessor prevents detonation of the one or more explosives or ingredients.

In yet another implementation, the microprocessor's device integrity check includes testing a voltage level of a battery supplying the control circuit and conditions initiator activation on the voltage level exceeding a threshold.

In yet another implementation, the explosive delivery receptacle comprises a warning light indicator, wherein the control circuit activates the warning light indicator during a pre-programmed digital delay.

In an eleventh embodiment, a digitally controlled explosive delivery device comprises a case, one or more reservoirs within the case to hold one or more explosive agents, an electrically activated initiator within the case operable to detonate the one or more explosive agents, a delay circuit contained within the case that is electrically connected to the initiator, and a microprocessor in the control circuit. When the microprocessor is activated, it delays initiator activation by the delay circuit until a pre-programmed digital delay has elapsed.

In one implementation, the delay is administered through an analog delay subcircuit, comprising a resistor and capacitor, in the delay circuit. Because the subcircuit is connected to a reset line of the microprocessor, the analog delay subcircuit delays startup of the microprocessor after power is applied to the delay circuit until a voltage output of the analog delay circuit reaches a threshold.

In a twelfth embodiment, a digitally controlled explosive delivery device comprises a case, one or more reservoirs within the case to hold one or more explosive agents, an electrically activated initiator within the case for detonating the one or more explosive agents, and a control circuit contained within the case that is electrically connected to the initiator. A microprocessor in the control circuit, when activated, checks one or more conditions and, on the basis of those conditions, performs either a detonation or firing sequence that electrically activates the initiator or a render-safe termination sequence that renders the control circuit incapable of activating the initiator.

LD.0105—Digital Render Safe Mechanism for a Grenade

In a thirteenth embodiment, a grenade comprises a case, one or more chemical agents (such as a fuel-air mixture or a lachrymator, a capsaicinoid, or noxious chemical agent) contained within the case, an electrically activated initiator, a control and safety check circuit, and an electrical fuse or circuit breaker. The electrically activated initiator is configured to generate a pressure wave to expel, mix, and/or detonate the chemical agents. The electrical fuse or circuit breaker is in an electrical path between a power supply and the initiator. In one implementation, the control circuit is configured to supply activating electricity to the initiator, check whether there was a failed activation event where the initiator failed to activate, and when a failed activation event is detected, blow the fuse or trip the circuit breaker. In another implementation, the control circuit is configured to check one or more conditions before supplying activating electricity to the initiator, and when a condition is not satisfied, blow the fuse or trip the circuit breaker, thereby disabling the grenade.

In one implementation, the control circuit provides first and second control circuit paths between first and second electrodes of the power supply and first and second electrodes of the initiator, respectively, and is configured to prevent activating current from flowing through either of the first and second control circuit paths. The control circuit is configured to blow the fuse or trip the circuit breaker by shunting current flowing from the power terminal through the fuse to ground. The control circuit is configured to prevent activating current from flowing through the second control circuit path by switching a second transistor in the second control circuit path.

In one implementation, the grenade further comprises a safety lever coupled to the case, a proximity sensor in the case that is electrically connected to the control circuit and physically proximate to a default pre-deployment position of the safety lever. One of the one or more conditions is that the safety lever be detached from the case. When the proximity sensor signals a proximate presence of the safety lever, the control circuit blows the fuse or trips the circuit breaker, disabling the grenade.

In another implementation, the grenade further comprises a restraining pin, a spring-biased striker, a spoon, a magnet in or on the spoon, and a reed switch. The spoon is coupled to the case. When the spoon is gripped against the case after the restraining pin is removed, it restrains the striker from closing a path between power and the control circuit. The reed switch is positioned to detect the magnet when the spoon is positioned against the case. The control circuit determines a proximate presence or absence of the magnet and blows the fuse or trips the circuit breaker if the magnet is detected.

In another implementation, the control circuit tests one or more voltage levels and conditions initiator activation on the one or more voltage levels meeting specifications, such as falling within a voltage range or exceeding a voltage threshold. The one or more tested voltage levels comprise the voltage level of the battery supplying the control circuit, the voltage level across the render safe fuse, an internal reference voltage of the microprocessor, and/or the voltage across the initiator.

In a fourteenth embodiment, a grenade comprises a case, one or more explosive agents contained within the case, an electrically activated initiator, an electrical fuse or circuit breaker, and a control circuit. The electrically activated initiator is configured to generate a pressure wave to expel, mix, and/or detonate the chemical agents. The electrical fuse or circuit breaker is in an electrical path between a power supply and the initiator. The control circuit configured to supply activating electricity to the initiator, check for the presence of an anomaly, and when an anomaly is detected, blow the fuse or trip the circuit breaker. In one example, the anomaly is a failed activation event where the initiator failed to activate after electricity was applied to the initiator. In another example, the anomaly is a detection of a voltage level that does not meet a threshold or fall within a specified range.

In one implementation, the grenade further comprises one or more LED indicator lights, and the control circuit is configured to turn on and flash at least one of the one or more LED indicator lights (preferably yellow signifying a caution-related condition) to indicate that the fuse has blown, or the circuit breaker has tripped.

LD.0106—Ruggedized Electrical Coupling

In the development of a grenade with separable reusable and disposable compartments, much effort went into the development of a shock-resistant electrical coupling between the two compartments. This electrical coupling has applications that extend far beyond the grenade. Accordingly, certain embodiments of the invention are directed to the electrical coupling without reference to a grenade, and other embodiments of the invention are directed to the combination of a grenade with the electrical coupling.

In a fifteenth embodiment, an electrical coupling has connectable and separable first and second components comprising at least a first electrical terminal mounted on the first component, at least a first corresponding electrical pad mounted on the second component, the first electrical terminal comprising a shaft, and the first corresponding electrical pad having a deposit of solder (preferably a malleable lead-free solder such as Indium or Indium-alloy). The first electrical terminal and the first corresponding electrical pad are arranged on the first component and the second component, respectively, so that when the first and second components are connected together, the first electrical terminal presses into and creates an interference fit with the malleable solder of the pad. In one implementation, there are two electrical terminals and two corresponding electrical pads, one for sending current and the other for receiving current.

In one implementation, the one or more electrical terminals are mounted on the first component via one or more springs. Furthermore, a platform (e.g., printed circuit board) containing the one or more corresponding electrical pads are mounted on the second component via a spring.

In one implementation, the shafts of the electrical terminals have tapered, frustoconical sides and a blunt end or tip. Generally, this makes the terminals resistant to bending or deformation. In implementations directed toward a fuel-air diversionary device, this configuration also partially deflects an air pressure wave directed at the first electrical terminal toward a base of the first component sideways.

In implementations that also include other aspects of the inventions of this disclosure, the one or more electrical pads are one or more electrodes of an electrically activated initiator, and the one or more electrical terminals are terminals for carrying power from a circuit-controlled power supply.

A sixteenth embodiment is directed to a shock-resistant two-compartment device having an electrical coupling between first and second compartments that are configured to be connected and nondestructively separated. A first circuit is held by the first compartment. A second circuit is held by the second compartment. A shock-resistant electrical coupling between the first and second circuits comprises at least a first electrical terminal mounted on the first compartment that is electrically connected to the first circuit and at least a first corresponding electrical pad held by the second compartment that is electrically connected to the second circuit. The first corresponding electrical pad has a deposit of solder (such as Indium or Indium-alloy). The first electrical terminal and the first corresponding electrical pad are arranged on the first compartment and the second compartment, respectively, so that when the first and second compartments are connected together, the first electrical terminal presses into and creates an interference fit with the solder of the pad. Also, in one implementation, the first electrical terminal comprises a tapered shaft with a blunt end.

In a seventeenth embodiment, a flash bang device comprises a compartment enclosing an electrical circuit and power supply, a cartridge configured to be mounted to the compartment, and one or more chemicals agents and an electrically ignitable primer to ignite the one or more chemical agents held within the cartridge. The flash bang device characterized in that the primer is configured to be electrically ignited by a current provided by the electrical circuit.

In one implementation, the compartment is ruggedized so that it can be reused with multiple cartridges after multiple detonations. For example, a bulkhead in the compartment protects the digital circuit from overpressure forces generated by the primer when it ignites.

Another ruggedized feature is an electrical coupling between the compartment and the cartridge. The electrical coupling includes ruggedized terminals that protrude from the compartment and electrical pads electrically connected to the primer that have a deposit of malleable lead-free solder. The terminal and electrical pad are arranged on the compartment and cartridge, respectively, so that when the compartment and cartridge are connected together, the first electrical terminal presses into and creates an interference fit with the malleable solder of the pad. In one implementation, the ruggedized terminals comprise shafts having frustoconical sides and a blunt end. In another implementation, the primer is a component of an airbag initiator held within the cartridge.

The flash bang device is also adaptable for use with binary explosives. In one implementation, the cartridge comprises at least two reservoirs that segregate components of a binary or tertiary explosive. Frangible corks are arranged in the at least two reservoirs between the primer and the chemical agents, the frangible corks serving to facilitate mixing and expulsion of substantially all of the chemical agents from the cartridge before a flame front ignites the chemical agents.

The flash bang device may also be configured to resemble a conventional grenade. In one implementation, a spring-loaded striker is mounted on the compartment and a pull pin is arranged on the compartment to hold the spring-loaded striker in a blocked position until the pull pin is removed. A safety lever arranged on the reusable compartment continues to hold the spring-loaded striker in the blocked position after the pull pin is removed for as long as the safety lever is grasped against the receptacle. When the pull pin is removed and the grasp released, the spring-loaded striker not only ejects the safety lever away from the remainder of the receptacle but also closes a power supply switch that provides power to the circuit.

The electrical circuit is design to increase the safety of the device. In one implementation, the electrical circuit comprises a resistor and a reactor element arranged to slow an increase in voltage at a node between the resistor and reactor element. The electrical circuit is prevented from activating the primer until the voltage at the node reaches a threshold, wherein the reactor element is a capacitor or inductor. In one implementation, values for the resistor and reactor element are selected to cause at least a 200 ms delay, and more preferably about a 300 ms delay, between release of the safety and enablement of a digital controller or microprocessor in the electrical circuit.

In another implementation, the electrical circuit includes a digital controller configured to perform one or more safety checks. For one such safety check implementation, a proximity sensor in the compartment is electrically connected to the electrical circuit and physically proximate to a default pre-deployment position of a safety lever. One of said safety checks is whether the safety lever has been released from the compartment. When the proximity sensor signals a proximate presence of the safety lever, the electrical circuit disables the flash bang device.

In another safety check implementation, the primer is activated by electricity passing through a bridgewire causing the bridgewire to heat up and ignite the primer. After attempting to ignite the primer, the digital controller checks whether current can still flow through the bridgewire. If the bridgewire still carries current, the digital controller disables the flash bang device and emits a signal that the flash bang device is safe to retrieve.

In one implementation, the electrical circuit also provides a render safe mechanism by incorporating a fuse or circuit breaker. If the one or more safety checks indicates an unsafe condition, the digital controller blows the fuse or circuit breaker, thereby disabling the flash bang device. In another implementation, a plurality of LED indicator lights is arranged on the compartment to indicate a status of the flash bang device.

Having thus described exemplary embodiments of the present invention, it should be noted that the disclosures contained in the drawings are exemplary only, and that various other alternatives, adaptations, and modifications may be made within the scope of the present invention. Accordingly, the present invention is not limited to the specific embodiments illustrated herein but is limited only by the following claims.

I claim:

1. A reusable hand-tossable grenade comprising:

one or more chemical agents which ignite upon expulsion from the reusable hand-tossable grenade; and an airbag initiator arranged in relation to the one or more chemical agents so that when the initiator is activated, it generates a pressure wave that expels the one or more chemical agents from the grenade thereby igniting the one or more chemical agents.

2. The reusable hand-tossable grenade of claim 1, further comprising:

a disposable cartridge having one or more reservoirs that store the one or more chemical agents prior to expulsion and a port that provides a fluid passageway between the airbag initiator and the reservoirs.

3. The reusable hand-tossable grenade of claim 2, further comprising:

a ruggedized reusable compartment to which the disposable cartridge is configured to be mounted, the reusable compartment housing the airbag initiator.

4. The reusable hand-tossable grenade of claim 1, further comprising:

a hand-holdable case;

at least first and second reservoirs in the case that segregate components of a binary explosive comprises from the one or more chemical agents prior to the grenade becoming a live grenade;

an outlet port;

wherein the chemical agents are mixed as they are expelled thru the outlet port.

5. The reusable hand-tossable grenade of claim 1, further comprising:

a primer selected to generate heat sufficient to detonate the chemical agents.

6. The reusable hand-tossable grenade of claim 5, further comprising:

a digital circuit including a wireless communications module that is configured to receive wireless instructions and, in response to an ignition instruction, check for a set of conditions and ignite the primer when the conditions are met, consequently detonating the chemical agents.

7. The reusable hand-tossable grenade of claim 6, further comprising:

a ruggedized reusable compartment to which a disposable cartridge is configured to be mounted, the reusable compartment enclosing the digital circuit.

8. The reusable hand-tossable grenade of claim 6, wherein the digital circuit, when activated, checks for a set of conditions and activates the primer when the conditions are met, consequently expelling the chemical agents.

9. The reusable hand-tossable grenade of claim 7, further comprising a high-strength bulkhead incorporated into the ruggedized reusable compartment that separates the digital circuit from the chemical agents, wherein the reusable compartment is sufficiently ruggedized to withstand the ignition of the primer and the detonation of the chemical agents to be reused with one or more additional disposable cartridges.

10. The reusable hand-tossable grenade of claim 6, further comprising a piston in each of the one or more reservoirs between the one or more chemical agents and the primer wherein the disposable cartridge, pistons, and the primer are respectively configured so that a blast generated by the primer's ignition pushes the pistons and the chemical agents in front of the pistons out of the reservoirs before the heat generated by the primer can detonate the explosive chemicals.

11. The reusable hand-tossable grenade of claim 10, further comprising:

a spring-loaded striker mounted on the ruggedized reusable compartment;

a pull pin arranged on the ruggedized reusable compartment to hold the spring-loaded striker in a blocked position until the pull pin is removed; and a hand-holdable safety lever arranged on the reusable compartment to continue holding the spring-loaded striker in the blocked position after the pull pin is removed for as long as the safety lever is grasped against the receptacle;

wherein when the pull pin is removed and the grasp released, the spring-loaded striker ejects the safety lever away from the remainder of the receptacle and closes a power supply switch that provides power to the digital circuit.

12. The reusable hand-tossable grenade of claim 11, further comprising a notch in the pull pin that engages the spring-loaded striker, raising a threshold of force required to remove the pull pin from the device.

13. The reusable hand-tossable grenade of claim 12, further comprising a thumb tab on the safety lever, the thumb tab providing a tactile reference of a top side of the receptacle.

14. The reusable hand-tossable grenade of claim 12, further comprising a latching magnet in a top of the reusable compartment that latches the striker to terminals of the power supply switch after the striker strikes the terminals, thereby minimizing striker bounce.

15. The reusable hand-tossable grenade of claim 14, further comprising a magnet embedded into the side of the safety lever.

16. The reusable hand-tossable grenade of claim 11, further comprising:

a high-strength bulkhead incorporated into the reusable or disposable compartment that separates the digital circuit from the chemical agents;

wherein the reusable compartment is sufficiently ruggedized to withstand the ignition of the primer and the detonation of the chemical agents to be reused with one or more additional disposable cartridges.

17. The reusable hand-tossable grenade of claim 16, further comprising one or more ruggedized activation terminals that protrude through small openings in the bulkhead to activate the initiator.

18. The reusable hand-tossable grenade of claim 17 wherein the ruggedized activation terminals are arranged to press into electrodes of the initiator.

19. The reusable hand-tossable grenade of claim 18, further comprising springs on which the activation terminals are mounted, the springs isolating the digital circuit from shock forces acting on the bulkhead.

20. A reusable hand-tossable grenade comprising:

one or more chemical agents which ignite upon expulsion from the reusable hand-tossable grenade;

an airbag initiator arranged in relation to the one or more chemical agents so that when the initiator is activated, it generates a pressure wave that expels the one or more chemical agents from the grenade thereby igniting the one or more chemical agents;

a hand-holdable case;

at least first and second reservoirs in the case that segregate components of a binary explosive comprised from the one or more chemical agents prior to the grenade becoming a Live grenade;

an outlet port;

wherein the chemical agents are mixed as they are expelled thru the outlet port.

* * * * *